US009772568B2

(12) United States Patent
Sekido et al.

(10) Patent No.: US 9,772,568 B2
(45) Date of Patent: Sep. 26, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kunihiko Sekido, Suntou-gun (JP); Michiyo Sekiya, Atami (JP); Kei Tagami, Yokohama (JP); Masashi Nishi, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/077,209

(22) Filed: Mar. 22, 2016

(65) Prior Publication Data

US 2016/0291489 A1 Oct. 6, 2016

(30) Foreign Application Priority Data

Mar. 30, 2015 (JP) ..... 2015-069746

(51) Int. Cl.
*G03G 5/14* (2006.01)

(52) U.S. Cl.
CPC ..... *G03G 5/142* (2013.01)

(58) Field of Classification Search
CPC ..... G03G 5/142; G03G 5/144
See application file for complete search history.

(56) References Cited

U.S. PATENT DOCUMENTS 5,455,135 A 10/1995 Maruyama et al.
5,604,061 A 2/1997 Sekido et al.
(Continued)

FOREIGN PATENT DOCUMENTS

JP 2001-083726 3/2001
JP 2003-345044 12/2003
JP 2007-079555 3/2007

OTHER PUBLICATIONS

Bulletin of Tokai Women's Junior College 7, (1980) 1-11.
(Continued)

*Primary Examiner* — Peter Vajda
(74) *Attorney, Agent, or Firm* — Fitzpatrick, Cella, Harper & Scinto

(57) ABSTRACT

Provided is an electrophotographic photosensitive member including a support, an undercoat layer, and a photosensitive layer in this order, in which: the undercoat layer does not contain a metal oxide, or contains the metal oxide but the content of the metal oxide in the undercoat layer is 10 mass % or less; and the undercoat layer contains a polymerized product of a composition containing at least one kind of anthraquinone derivative selected from the group consisting of a compound represented by the formula (1) and a compound represented by the formula (2).
(Continued)

(1)

(2)

9 Claims, 2 Drawing Sheets

(56) References Cited

U.S. PATENT DOCUMENTS

| | | | |
|---|---|---|---|
| 5,693,443 | A | 12/1997 | Nakamura et al. |
| 6,110,628 | A | 8/2000 | Sekiya et al. |
| 6,228,546 | B1 | 5/2001 | Kashizaki et al. |
| 6,372,397 | B1 | 4/2002 | Maruyama et al. |
| 6,436,597 | B2 | 8/2002 | Maruyama et al. |
| 6,664,014 | B1 | 12/2003 | Kikuchi et al. |
| 7,141,341 | B2 | 11/2006 | Sekido et al. |
| 7,378,205 | B2 | 5/2008 | Sekiya et al. |
| 8,343,699 | B2 | 1/2013 | Nagasaka et al. |
| 8,465,889 | B2 | 6/2013 | Sekido et al. |
| 8,524,430 | B2 | 9/2013 | Takagi et al. |
| 8,546,050 | B2 | 10/2013 | Maruyama et al. |
| 8,632,931 | B2 | 1/2014 | Sekido et al. |
| 8,795,936 | B2 | 8/2014 | Sekido et al. |
| 9,029,054 | B2 | 5/2015 | Okuda et al. |
| 9,063,505 | B2 | 6/2015 | Sekiya et al. |
| 9,069,267 | B2 | 6/2015 | Kaku et al. |
| 9,164,406 | B2 | 10/2015 | Nishi et al. |
| 9,207,550 | B2 | 12/2015 | Okuda et al. |
| 9,280,072 | B2 | 3/2016 | Ogaki et al. |
| 2009/0202937 | A1* | 8/2009 | Kinoshita ..... G03G 5/142 430/131 |
| 2012/0244462 | A1* | 9/2012 | Takahashi ..... C07C 46/00 430/60 |
| 2015/0185630 | A1 | 7/2015 | Ito et al. |
| 2015/0185632 | A1 | 7/2015 | Sekido et al. |
| 2015/0185633 | A1 | 7/2015 | Tagami et al. |
| 2015/0185634 | A1 | 7/2015 | Sekiya et al. |
| 2015/0185636 | A1 | 7/2015 | Sekiya et al. |
| 2015/0185637 | A1 | 7/2015 | Nishi et al. |
| 2015/0185638 | A1 | 7/2015 | Nakamura et al. |
| 2016/0116853 | A1 | 4/2016 | Sekiya et al. |

OTHER PUBLICATIONS

Shinzo Yamashita et al., "Crosslinking Agent Handbook" Taiseisha Ltd. (1981) 536-605.

Taher, et al., "Synthesis of novel bis-anthraquinone derivatives and their biological evaulation as antitumor agents", Archives of Pharmacal Research, vol. 36, No. 5 (2013) 573-78.

U.S. Appl. No. 08/635,520, filed Apr. 22, 1996, Akihiro Senoo.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus each including the electrophotographic photosensitive member.

Description of the Related Art

An electrophotographic photosensitive member containing an organic photoconductive substance (charge generating substance) has been mainly used as an electrophotographic photosensitive member to be mounted to a process cartridge or an electrophotographic apparatus. In recent years, there has been a growing requirement for the quality of an electrophotographic image, and hence an improvement has been attempted to correspond to various technical problems in the electrophotographic photosensitive member. For example, the following method has been known as a method of solving technical problems caused by the inflow of a hole from a support, such as a black spot and ground fogging. An undercoat layer is arranged between the support and a photosensitive layer to suppress the inflow of the hole from the support by virtue of its blocking function. On the other hand, when the resistance of the undercoat layer is excessively high, it becomes difficult to transport an electron generated in the photosensitive layer to the support, and hence a positive ghost (phenomenon in which during the formation of one image, when a portion irradiated with light becomes a halftone image in the next rotation of the electrophotographic photosensitive member, the density of only the portion irradiated with light becomes high) occurs in some cases.

A method involving controlling the resistance through the use of a metal oxide as an electro-conductive agent has been proposed as one method of suppressing the positive ghost, but the method reduces the blocking function of the undercoat layer itself.

In view of the foregoing, an investigation has been made on a method of suppressing the positive ghost even when the metal oxide is not incorporated or is incorporated but its amount is small (the content of the metal oxide in the undercoat layer is 10 mass % or less). Specifically, a technology involving incorporating an electron transporting substance into the undercoat layer has been known for improving the electron transporting ability of the undercoat layer (Japanese Patent Application Laid-Open No. 2001-83726 and Japanese Patent Application Laid-Open No. 2003-345044).

In each of Japanese Patent Application Laid-Open No. 2001-83726 and Japanese Patent Application Laid-Open No. 2003-345044, there is a disclosure of a method involving incorporating the electron transporting substance, such as a fluorenone compound derivative or an imide compound derivative, into the undercoat layer.

SUMMARY OF THE INVENTION

According to one aspect of the present invention, there is provided an electrophotographic photosensitive member, including, in this order:

a support;

an undercoat layer; and a photosensitive layer, in which:

the undercoat layer is free of a metal oxide, or contains the metal oxide but a content of the metal oxide in the undercoat layer is 10 mass % or less; and the undercoat layer contains a polymerized product of a composition containing at least one kind of anthraquinone derivative selected from the group consisting of a compound represented by the formula (1) and a compound represented by the formula (2):

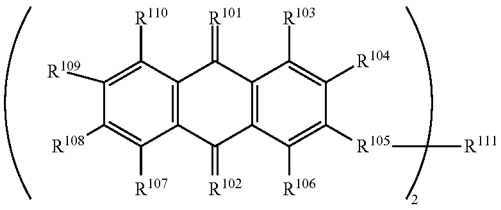

(1)

in the formula (1):

$R^{101}$ and $R^{102}$ each independently represent an oxygen atom, $C(CN)_2$, $C(CN)R^{112}$, or $NR^{113}$, and $R^{112}$ and $R^{113}$ each represent a substituted or unsubstituted aryl group;

$R^{103}$ and $R^{104}$, and $R^{106}$ to $R^{110}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{111}$ represents a substituted or unsubstituted alkylene group, a substituted or unsubstituted cycloalkylene group, a substituted or unsubstituted arylene group, or a substituted or unsubstituted heterocyclic group, a group derived by substituting part of a methylene group in a main chain of the substituted or unsubstituted alkylene group with at least one kind selected from the group consisting of an oxygen atom, a sulfur atom, NH, $NR^{114}$, a carbonyl group, a sulfonyl group (O═S═O), a substituted or unsubstituted cycloalkylene group, and a substituted or unsubstituted arylene group, a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{114}$, a carbonyl group, and a sulfonyl group, or a group obtained by bonding, to the substituted or unsubstituted arylene group or the divalent group obtained by the bonding with the bonding group, at least one kind selected from the group consisting of an oxygen atom, a sulfur atom, NH, $NR^{115}$, a carbonyl group, and a sulfonyl group;

$R^{114}$ and $R^{115}$ each independently represent an alkyl group or an aryl group;

at least one of $R^{103}$ and $R^{104}$, and $R^{106}$ to $R^{111}$ represents a group having any one of a hydroxy group, a thiol group, an amino group, and a carboxyl group; and $R^{105}$ represents a methylene group, a carbonyl group, an oxygen atom, or NH:

(2)

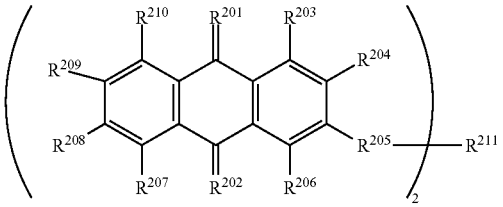

in the formula (2):

$R^{201}$ and $R^{202}$ each independently represent an oxygen atom, $C(CN)_2$, $C(CN)R^{212}$, or $NR^{213}$, and $R^{212}$ and $R^{213}$ each represent a substituted or unsubstituted aryl group;

$R^{203}$ to $R^{205}$ and $R^{207}$ to $R^{210}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{211}$ represents a substituted or unsubstituted alkylene group, a substituted or unsubstituted cycloalkylene group, a substituted or unsubstituted arylene group, or a substituted or unsubstituted heterocyclic group, a group derived by substituting part of a methylene group in a main chain of the substituted or unsubstituted alkylene group with at least one kind selected from the group consisting of an oxygen atom, a sulfur atom, NH, $NR^{214}$, a carbonyl group, a sulfonyl group, a substituted or unsubstituted cycloalkylene group, and a substituted or unsubstituted arylene group, a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{214}$, a carbonyl group, and a sulfonyl group, or a group obtained by bonding, to the substituted or unsubstituted arylene group or the divalent group obtained by the bonding with the bonding group, at least one kind selected from the group consisting of an oxygen atom, a sulfur atom, NH, $NR^{215}$, a carbonyl group, and a sulfonyl group;

$R^{214}$ and $R^{215}$ each independently represent an alkyl group or an aryl group;

at least one of $R^{203}$ to $R^{205}$ and $R^{207}$ to $R^{211}$ represents a group having any one of a hydroxy group, a thiol group, an amino group, and a carboxyl group; and $R^{206}$ represents a methylene group, a carbonyl group, an oxygen atom, or NH.

According to another aspect of the present invention, there is provided a process cartridge, including: the electrophotographic photosensitive member; and at least one device selected from the group consisting of a charging device, a developing device, a transferring device, and a cleaning device, the process cartridge integrally supporting the electrophotographic photosensitive member and the at least one device, the process cartridge being detachably mountable to a main body of an electrophotographic apparatus.

According to further aspect of the present invention, there is provided an electrophotographic apparatus, including: the electrophotographic photosensitive member; a charging device; an exposing device; a developing device; and a transferring device.

Further features of the present invention will become apparent from the following description of exemplary embodiments with reference to the attached drawings.

DESCRIPTION OF THE EMBODIMENTS

Figure 1:
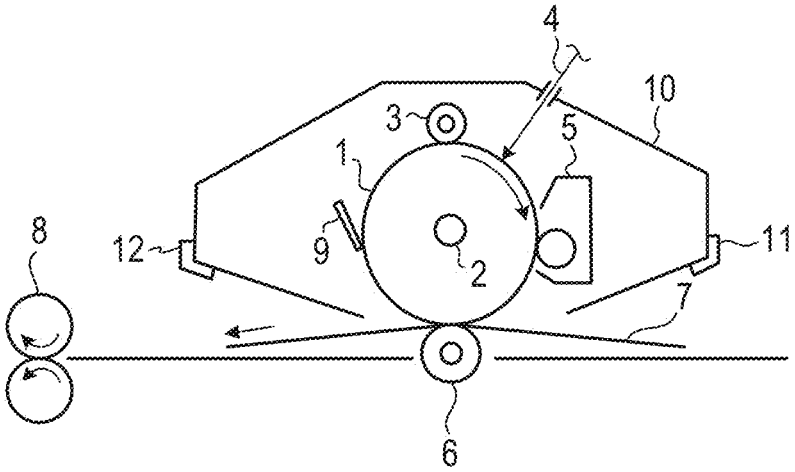
FIG. 1 is a view for illustrating a schematic configuration of an electrophotographic apparatus including a process cartridge including an electrophotographic photosensitive member of the present invention.

Preferred embodiments of the present invention will now be described in detail in accordance with the accompanying drawings.

An investigation made by the inventors of the present invention has found that the related art is still susceptible to improvement with regard to the suppression of a positive ghost.

The present invention is directed to providing an electrophotographic photosensitive member suppressed in positive ghost even when an undercoat layer does not contain a metal oxide or contains the metal oxide but the content of the metal oxide in the undercoat layer is 10 mass % or less, and a process cartridge and an electrophotographic apparatus each including the electrophotographic photosensitive member.

The inventors of the present invention have made an extensive investigation, and as a result, have found that the incorporation of a polymerized product of a compound having a specific structure into the undercoat layer of an electrophotographic photosensitive member can achieve a high level of suppression of a positive ghost.

The electrophotographic photosensitive member of the present invention includes, in this order: a support; an undercoat layer; and a photosensitive layer, in which: the undercoat layer is free of a metal oxide, or contains the metal oxide but a content of the metal oxide in the undercoat layer is 10 mass % or less; and the undercoat layer contains a polymerized product of a composition containing at least one kind of anthraquinone derivative selected from the group consisting of a compound represented by the formula (1) and a compound represented by the formula (2). The respective layers and compounds to be used in the respective layers are described below. It should be noted that, for example, the compounds to be used in the present invention were identified by the following method.

Mass Spectrometry

A matrix-assisted laser desorption/ionization time-of-flight mass spectrometry (MALDI-TOF MS: ultraflex manufactured by Bruker Daltonics) was used. The condition of the method was as follows: acceleration voltage: 20 kV, mode: Reflector, and molecular weight standard: fullerene $C_{60}$. The molecular weight of the compound was confirmed by the value of an obtained peak top.

[Support]

The support is preferably a support having electro-conductivity (electro-conductive support). Examples thereof include supports made of metals, such as aluminum, nickel, copper, gold, and iron, or of alloys thereof. In addition, the examples include supports each obtained by forming, on an insulating support, such as a polyester, a polycarbonate, a polyimide, or a glass, a thin film of a metal, such as aluminum, silver, or gold, or a thin film of an electroconductive material, such as indium oxide or tin oxide.

The surface of the support may be subjected to an electrochemical treatment, such as anodization, or a treatment, such as wet honing, blasting, or cutting, in order that its electrical characteristics may be improved and interference fringes that are liable to occur at the time of irradiation with coherent light, such as semiconductor laser, may be suppressed.

[Undercoat Layer]

The undercoat layer is arranged between the photosensitive layer and the support. In the present invention, the undercoat layer does not contain the metal oxide, or contains the metal oxide but the content of the metal oxide in the undercoat layer is 10 mass % or less. Further, the undercoat layer contains the polymerized product (cured product) of the composition containing at least one kind of anthraquinone derivative (electron transporting substance) selected from the group consisting of the compound represented by the formula (1) and the compound represented by the formula (2). In addition, the undercoat layer preferably contains a polymerized product (cured product) of a composition further containing a crosslinking agent or a macromonomer (resin) having a polymerizable functional group together with at least one kind of anthraquinone derivative selected from the group consisting of the compound represented by the formula (1) and the compound represented by the formula (2).

The undercoat layer can be formed as described below. First, a coating film of an undercoat layer coating liquid containing the composition containing at least one kind of anthraquinone derivative selected from the group consisting of the compound represented by the formula (1) and the compound represented by the formula (2) (and any other material) is formed. Then, the coating film is dried. At the time of the drying of the coating film of the undercoat layer coating liquid, the compound represented by the formula (1) or the compound represented by the formula (2) polymerizes. At that time, the application of the energy of heat or light accelerates the polymerization reaction (curing reaction).

The thickness of the undercoat layer is preferably 0.1 μm or more and 1.5 μm or less, more preferably 0.2 μm or more and 0.7 μm or less.

The inventors of the present invention have assumed the reason why the electrophotographic photosensitive member having the undercoat layer of the present invention excels in suppressing a positive ghost and in suppressing the fluctuation of a positive ghost level after continuous image output as compared with that before the output to be as described below.

The adoption of a material that polymerizes in the undercoat layer has many advantages. For example, the solvent resistance improves. However, particularly when the transfer of an electron is performed by intermolecular hopping through the use of an electron transporting substance, the flexibility of a molecular structure reduces and hence the delivery of the electron is liable to become lower. Accordingly, it becomes additionally important that a site that structurally serves as a charge trap be not produced.

However, when a material having a large flat plate structure is used as the electron transporting substance to be incorporated into the undercoat layer, the material having a flat plate structure are liable to be oriented, and hence a site having a low electron transporting substance concentration is liable to be a charge trap.

In contrast, in the present invention, the compound represented by the formula (1) or the compound represented by the formula (2) serving as a specific electron transporting substance is used. The compound represented by the formula (1) or the formula (2) has, as an electron transporting site, an anthraquinone skeleton having a large flat plate structure, but is of a structure in which the electron transporting sites are linked to each other by crosslinking sites having no electron transporting sites ($R^{105}$ and $R^{111}$, or $R^{206}$ and $R^{211}$). Accordingly, in the present invention, it is assumed that the case where only the electron transporting site is oriented is excluded, and hence the delivery of an electron is not inhibited. Probably as a result of the foregoing, a suppressing effect on a positive ghost caused by the retention of the electron and a suppressing effect on the fluctuation of a positive ghost level after continuous image output as compared with that before the output are produced.

The anthraquinone derivative, the crosslinking agent, the macromonomer having a polymerizable functional group, and any other material which the composition may contain are each described below.

(Anthraquinone Derivative)

The content of a structure derived from at least one kind of anthraquinone derivative selected from the group consisting of the compound represented by the formula (1) and the compound represented by the formula (2) in the undercoat layer is preferably 30 mass % or more, more preferably 40 mass % or more, particularly preferably 50 mass % or more with respect to the total mass of the composition forming the undercoat layer. In addition, the content is preferably 90 mass % or less, more preferably 80 mass % or less.

The compound represented by the formula (1) and the compound represented by the formula (2) to be used in the undercoat layer of the present invention are described.

Compound represented by Formula (1)

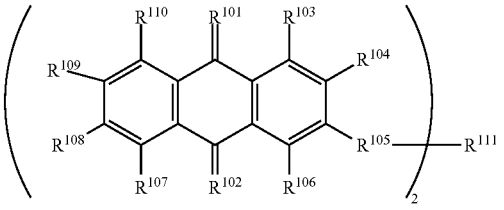

(1)

(In the formula (1):

$R^{101}$ and $R^{102}$ each independently represent an oxygen atom, $C(CN)_2$, $C(CN)R^{112}$, or $NR^{113}$, and $R^{112}$ and $R^{113}$ each represent a substituted or unsubstituted aryl group;

$R^{103}$ and $R^{104}$, and $R^{106}$ to $R^{110}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{111}$ represents a substituted or unsubstituted alkylene group, a substituted or unsubstituted cycloalkylene group, a substituted or unsubstituted arylene group, or a substituted or unsubstituted heterocyclic group, a group derived by substituting part of a methylene group in a main chain of the substituted or unsubstituted alkylene group with at least one kind selected from the group consisting of an oxygen atom, a sulfur atom, NH, $NR^{114}$, a carbonyl group, a sulfonyl group (O═S═O), a substituted or unsubstituted cycloalkylene group, and a substituted or unsubstituted arylene group, a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{114}$, a carbonyl group, and a sulfonyl group, or a group obtained by bonding, to the substituted or unsubstituted arylene group or the divalent group obtained by the bonding with the bonding group, at least one kind selected from the group consisting of an oxygen atom, a sulfur atom, NH, $NR^{115}$, a carbonyl group, and a sulfonyl group;

$R^{114}$ and $R^{115}$ each independently represent an alkyl group or an aryl group;

at least one of $R^{103}$ and $R^{104}$, and $R^{106}$ to $R^{111}$ represents a group having any one of a hydroxy group, a thiol group, an amino group, and a carboxyl group; and $R^{105}$ represents a methylene group, a carbonyl group, an oxygen atom, or NH.)

Compound represented by Formula (2)

(2)

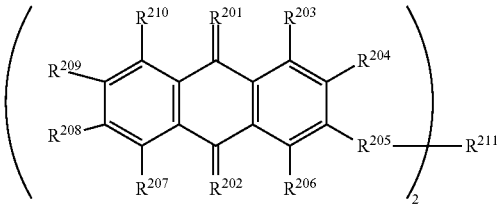

(in the formula (2):

$R^{201}$ and $R^{202}$ each independently represent an oxygen atom, $C(CN)_2$, $C(CN)R^{212}$, or $NR^{213}$, and $R^{212}$ and $R^{213}$ each represent a substituted or unsubstituted aryl group;

$R^{203}$ to $R^{205}$ and $R^{207}$ to $R^{210}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{211}$ represents a substituted or unsubstituted alkylene group, a substituted or unsubstituted cycloalkylene group, a substituted or unsubstituted arylene group, or a substituted or unsubstituted heterocyclic group, a group derived by substituting part of a methylene group in a main chain of the substituted or unsubstituted alkylene group with at least one kind selected from the group consisting of an oxygen atom, a sulfur atom, NH, $NR^{214}$, a carbonyl group, a sulfonyl group, a substituted or unsubstituted cycloalkylene group, and a substituted or unsubstituted arylene group, a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{214}$, a carbonyl group, and a sulfonyl group, or a group obtained by bonding, to the substituted or unsubstituted arylene group or the divalent group obtained by the bonding with the bonding group, at least one kind selected from the group consisting of an oxygen atom, a sulfur atom, NH, $NR^{215}$, a carbonyl group, and a sulfonyl group;

$R^{214}$ and $R^{215}$ each independently represent an alkyl group or an aryl group;

at least one of $R^{203}$ to $R^{205}$ and $R^{207}$ to $R^{211}$ represents a group having any one of a hydroxy group, a thiol group, an amino group, and a carboxyl group; and $R^{206}$ represents a methylene group, a carbonyl group, an oxygen atom, or NH.)

The functional groups and the substituents in the formula (1) and the formula (2) are further described below.

In $R^{112}$, $R^{113}$, $R^{212}$, and $R^{213}$, for example, a phenyl group, a biphenyl group, and a naphthyl group are given as an aryl group of the substituted or unsubstituted aryl group.

In $R^{112}$, $R^{113}$, $R^{212}$, and $R^{213}$, as a substituent of the substituted aryl group, there are given, for example: alkyl groups, such as a methyl group, an ethyl group, a propyl group, and a butyl group; a carboxyl group; a halogen atom, such as a fluorine atom; a nitro group; a cyano group; alkoxycarbonyl groups, such as a methoxycarbonyl group and an ethoxycarbonyl group; and hydroxyalkyl groups, such as a hydroxymethyl group (methylol group) and a hydroxyethyl group (ethylol group).

In $R^{103}$, $R^{104}$, $R^{106}$ to $R^{110}$, $R^{203}$ to $R^{205}$, and $R^{207}$ to $R^{210}$, examples of the group having any one of a hydroxy group, a thiol group, an amino group, and a carboxyl group include a hydroxy group, a thiol group, an amino group, a carboxyl group, hydroxyalkyl groups, such as a hydroxymethyl group and a hydroxyethyl group, and a carboxyalkyl group, such as carboxymethyl. It should be noted that the compound represented by the formula (1) and the compound represented by the formula (2) may each have only one or a plurality of the groups having any one of a hydroxy group, a thiol group, an amino group, and a carboxyl group.

In $R^{103}$, $R^{104}$, $R^{106}$ to $R^{110}$, $R^{203}$ to $R^{205}$, and $R^{207}$ to $R^{210}$, as an alkyl group of the substituted or unsubstituted alkyl group, there are given, for example, a methyl group, an ethyl group, and a propyl group.

In $R^{103}$, $R^{104}$, $R^{106}$ to $R^{110}$, $R^{203}$ to $R^{205}$, and $R^{207}$ to $R^{210}$, for example, a phenyl group is given as an aryl group of the substituted or unsubstituted aryl group.

In $R^{103}$, $R^{104}$, $R^{106}$ to $R^{110}$, $R^{203}$ to $R^{205}$, and $R^{207}$ to $R^{210}$, for example, a hydroxy group, a thiol group, an amino group, a carboxyl group, and a halogen atom, such as a fluorine atom, are given as substituents of the substituted alkyl group and the substituted aryl group.

In $R^{103}$, $R^{104}$, $R^{106}$ to $R^{110}$, $R^{203}$ to $R^{205}$, and $R^{207}$ to $R^{210}$, examples of the halogen atom include a fluorine atom and a chlorine atom.

In $R^{103}$, $R^{104}$, $R^{106}$ to $R^{110}$, $R^{203}$ to $R^{205}$, and $R^{207}$ to $R^{210}$, examples of the alkoxy group include a methoxy group, an ethoxy group, and a propoxy group.

In $R^{103}$, $R^{104}$, $R^{106}$ to $R^{110}$, $R^{203}$ to $R^{205}$, and $R^{207}$ to $R^{210}$, examples of the alkoxycarbonyl group include a methoxycarbonyl group and an ethoxycarbonyl group.

$R^{111}$ represents, for example, a substituted or unsubstituted alkylene group, a substituted or unsubstituted cycloalkylene group, a substituted or unsubstituted arylene group, or a substituted or unsubstituted heterocyclic group. In addition, $R^{111}$ may represent a group derived by substituting part of a methylene group in the main chain of the substituted or unsubstituted alkylene group with at least one kind selected from the group consisting of an oxygen atom, a sulfur atom, NH, $NR^{114}$ (where $R^{114}$ represents an alkyl group or an aryl group), a carbonyl group, a sulfonyl group, a substituted or unsubstituted cycloalkylene group, and a substituted or unsubstituted arylene group. In addition, $R^{111}$ may represent a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{114}$ (where $R^{114}$ represents an alkyl group or an aryl group), a carbonyl group, and a sulfonyl group. In addition, $R^{111}$ may represent a group obtained by bonding, to the substituted or unsubstituted arylene group or the divalent group obtained by the bonding with the bonding group, at least one kind selected from the group consisting of an oxygen atom, a sulfur atom, NH, $NR^{115}$ (where $R^{115}$ represents an alkyl group or an aryl group), a carbonyl group, and a sulfonyl group. It should be noted that the main chain of the alkylene group refers to such a carbon chain that carbon atoms at both of its terminals are bonded to other groups out of the carbon chains of the alkylene group.

$R^{211}$ represents, for example, a substituted or unsubstituted alkylene group, a substituted or unsubstituted cycloalkylene group, a substituted or unsubstituted arylene group, or a substituted or unsubstituted heterocyclic group. In addition, $R^{211}$ may represent a group derived by substituting part of a methylene group in the main chain of the substituted or unsubstituted alkylene group with at least one kind selected from the group consisting of an oxygen atom, a sulfur atom, NH, $NR^{214}$ (where $R^{214}$ represents an alkyl group or an aryl group), a carbonyl group, a sulfonyl group, a substituted or unsubstituted cycloalkylene group, and a substituted or unsubstituted arylene group. In addition, $R^{211}$ may represent a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{214}$ (where $R^{214}$ represents an alkyl group or an aryl group), a carbonyl group, and a sulfonyl group. In addition, $R^{211}$ may represent a group obtained by bonding, to the substituted or unsubstituted arylene group or the divalent group obtained by the bonding with the bonding group, at least one kind selected from the group consisting of an oxygen atom, a sulfur atom, NH, $NR^{215}$ (where $R^{215}$ represents an alkyl group or an aryl group), a carbonyl group, and a sulfonyl group.

In $R^{111}$ and $R^{211}$, as an alkylene group of the substituted or unsubstituted alkylene group, there are given, for example, a methylene group, an ethylene group, a propylene group, a butylene group, a pentylene group, a hexylene group, a cyclohexylene group, a heptylene group, an octylene group, a nonylene group, a decylene group, and a dodecylene group.

In $R^{111}$ and $R^{211}$, for example, a cyclohexylene group is given as a cycloalkylene group of the substituted or unsubstituted cycloalkylene group.

In $R^{111}$ and $R^{211}$, for example, a phenylene group, a biphenylene group, and a naphthylene group are given as an arylene group of the substituted or unsubstituted arylene group.

In $R^{111}$ and $R^{211}$, for example, a triazole ring, a thiophene ring, and a pyridine ring are given as a heterocyclic group of the substituted or unsubstituted heterocyclic group.

In $R^{111}$ and $R^{211}$, for example, a cyclohexylene group is given as a cycloalkylene group of the substituted or unsubstituted cycloalkylene group that substitutes part of a methylene group in the main chain of the alkylene group.

In $R^{111}$ and $R^{211}$, for example, a phenylene group and a naphthylene group are given as an arylene group of the substituted or unsubstituted arylene group that substitutes part of a methylene group in the main chain of the alkylene group.

In $R^{111}$ and $R^{211}$, as substituents of the substituted alkylene group, the substituted cycloalkylene group, the substituted arylene group, the substituted heterocyclic group, and the substituted cycloalkylene group or substituted arylene group that substitutes a methylene group in the main chain of the alkylene group, there are given, for example: alkyl groups, such as a methyl group and an ethyl group; an aryl group, such as a phenyl group; a hydroxy group; a thiol group; an amino group; a carboxyl group; halogen atoms, such as a fluorine atom and a chlorine atom; a carboxyalkyl group, such as a carboxymethyl group; and an alkoxycarbonyl group, such as a methoxycarbonyl group.

In $R^{111}$ and $R^{211}$, an example of the group having any one of a hydroxy group, a thiol group, an amino group, and a carboxyl group is a group in which each of the substituents of the substituted alkylene group, the substituted cycloalkylene group, the substituted arylene group, the substituted cycloalkylene group or the substituted arylene group that substitutes a methylene group in the main chain of the alkylene group, and the substituted heterocyclic group is a hydroxy group, a thiol group, an amino group, a carboxyl group, a hydroxyalkyl group, such as a hydroxymethyl group or a hydroxyethyl group, or a carboxyalkyl group, such as a carboxymethyl.

In $R^{114}$, $R^{115}$, $R^{214}$, and $R^{215}$, an example of the alkyl group is a methyl group, and an example of the aryl group is a phenyl group.

Of the anthraquinone derivatives, an anthraquinone derivative in which $R^{105}$ or $R^{206}$ represents methylene ($CH_2$), an oxygen atom, or NH is preferred to an anthraquinone derivative in which $R^{105}$ or $R^{206}$ represents a carbonyl group (C=O) from the viewpoint of a positive ghost suppressing effect under low humidity. This is assumed to be because $R^{105}$ or $R^{206}$ is a site closest to the anthraquinone skeleton out of the linking groups, and hence affects the conformation of anthraquinone structures. In addition, an anthraquinone derivative in which $R^{105}$ or $R^{206}$ represents a carbonyl group, methylene, or NH is preferred to an anthraquinone derivative in which $R^{105}$ or $R^{206}$ represents an oxygen atom from the viewpoint of a positive ghost suppressing effect under high humidity. This is assumed to be because of the hydrophilicity of an oxygen atom site.

In addition, the anthraquinone derivative in which $R^{101}$ and $R^{102}$ or $R^{201}$ and $R^{202}$ each represent an oxygen atom is preferred to the anthraquinone derivative in which $R^{101}$ and $R^{102}$ or $R^{201}$ and $R^{202}$ each represent an iminated group. In addition, the anthraquinone derivative in which $R^{101}$ and $R^{102}$ or $R^{201}$ and $R^{202}$ are each subjected to cyanated methylene modification is preferred to the anthraquinone derivative in which $R^{101}$ and $R^{102}$ or $R^{201}$ and $R^{202}$ each represent an oxygen atom. It is assumed that the electron accepting properties of $R^{101}$ and $R^{102}$ or $R^{201}$ and $R^{202}$ affect electron density of the entire anthraquinone structure so that a difference in electron donation and acceptance occurs.

Specific Examples of Compound Represented by Formula (1) and Compound Represented by Formula (2)

Specific examples of the compound represented by the formula (1) and the compound represented by the formula (2) are shown in Table 1 to Table 6 below, but the present invention is not limited to these compounds. It should be noted that in Table 1 to Table 6, Me represents a methyl group, Et represents an ethyl group, Ph represents a phenyl group, and a dotted line represents a bonding hand.

TABLE 1

| Compound No. | $R^{101}$ | $R^{102}$ | $R^{103}$ | $R^{104}$ | $R^{105}$ | $R^{106}$ | $R^{107}$ | $R^{108}$ | $R^{109}$ | $R^{110}$ | $R^{111}$ |
|---|---|---|---|---|---|---|---|---|---|---|---|
| E101 | O | O | H | H | NH | OH | H | OH | H | H | 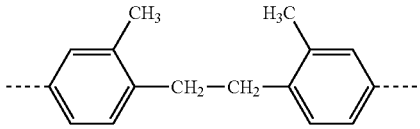 |
| E102 | O | O | H | H | NH | H | OH | H | H | H | $(CH_2)_4$ |
| E103 | O | O | H | H | NH | H | COOH | H | H | H | 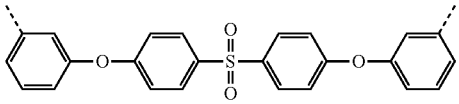 |
| E104 | O | O | H | H | $CH_2$ | H | OH | $CH_2OH$ | H | H | 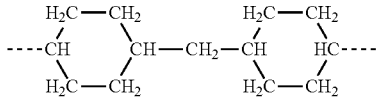 |
| E105 | O | O | H | H | NH | H | H | OH | H | H | 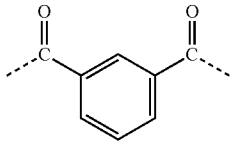 |
| E106 | O | O | H | H | NH | H | H | OH | H | H | 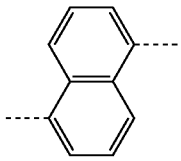 |
| E107 | O | O | H | H | O | H | H | OH | H | H | 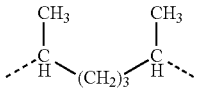 |
| E108 | O | O | H | H | C═O | H | H | OH | H | H | 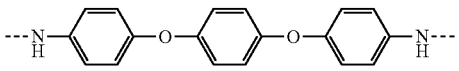 |
| E109 | O | O | H | H | C═O | H | H | OH | H | H | 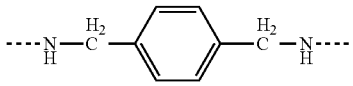 |
| E110 | O | O | H | H | O | H | H | OH | H | H | 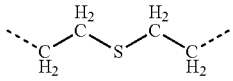 |
| E111 | O | O | H | H | NH | H | H | H | H | H | 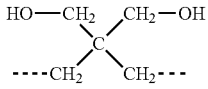 |
| E112 | O | O | H | H | NH | H | H | H | H | H | 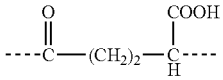 |

TABLE 1-continued
| Compound No. | $R^{101}$ | $R^{102}$ | $R^{103}$ | $R^{104}$ | $R^{105}$ | $R^{106}$ | $R^{107}$ | $R^{108}$ | $R^{109}$ | $R^{110}$ | $R^{111}$ |
|---|---|---|---|---|---|---|---|---|---|---|---|
| E113 | O | O | H | H | C═O | H | H | H | H | H | 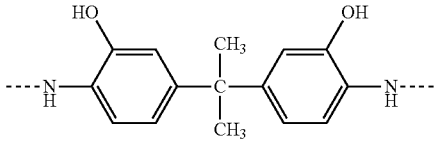 |
| E114 | O | O | H | H | O | H | H | H | H | H | 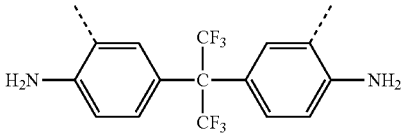 |
| E115 | O | O | H | H | $CH_2$ | H | H | CN | CN | H | 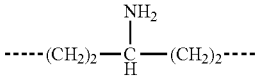 |
| E116 | O | O | H | H | NH | H | H | H | H | Cl | 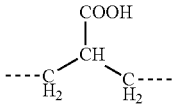 |
TABLE 2
| Compound No. | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $R^{211}$ |
|---|---|---|---|---|---|---|---|---|---|---|---|
| E117 | O | O | H | H | H | C═O | Cl | H | H | Cl | 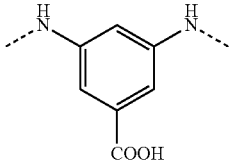 |
| E118 | O | O | H | H | H | NH | H | H | H | Et | 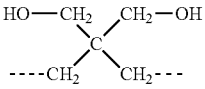 |
| E119 | O | O | H | H | H | C═O | H | H | H | Me | 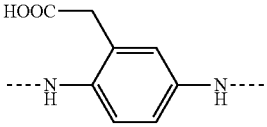 |
| E120 | O | O | H | H | H | NH | H | H | H | $NO_2$ | 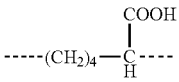 |
| E121 | O | O | H | H | H | NH | OH | $CH_2OH$ | H | H | 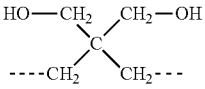 |
| E122 | O | O | H | H | H | NH | OH | $CH_2OH$ | H | H | 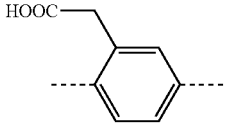 |
| E123 | O | O | H | H | H | $CH_2$ | COOH | H | H | H | 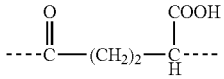 |

TABLE 2-continued
| Compound No. | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $R^{211}$ |
|---|---|---|---|---|---|---|---|---|---|---|---|
| E124 | O | O | H | H | H | C=O | COOH | H | H | H | 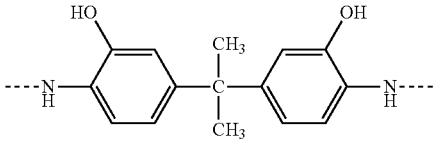 |
| E125 | O | O | H | H | H | C=O | H | OH | H | H | 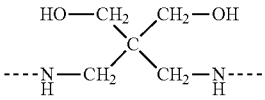 |
| E126 | O | O | H | CN | H | C=O | H | OH | H | H | 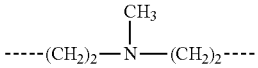 |
| E127 | O | O | H | F | H | C=O | H | OH | H | H | 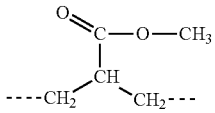 |
| E128 | O | O | H | $COOCH_3$ | H | C=O | H | OH | H | H | 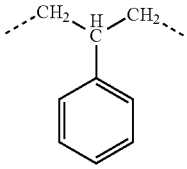 |
| E129 | O | O | H | $CF_3$ | H | C=O | H | OH | H | H | 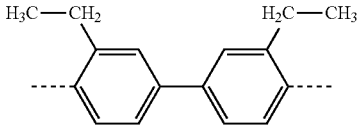 |
| E130 | O | O | H | $NO_2$ | H | C=O | H | OH | H | H | 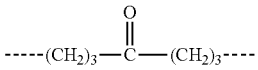 |
| E131 | O | O | H | $C_3H_7$ | H | C=O | H | OH | H | H | 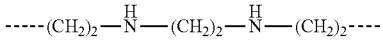 |
| E132 | O | O | H | Ph | H | C=O | H | OH | H | H | 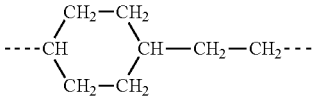 |
| E133 | O | O | H | $OC_2H_5$ | H | C=O | H | OH | H | H | 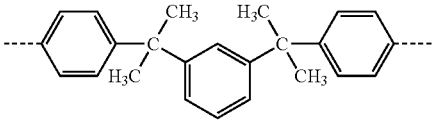 |
| E134 | O | O | H | Cl | H | C=O | H | OH | H | H | 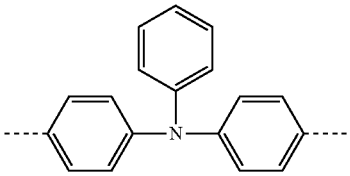 |
| E135 | O | O | H | H | H | C=O | H | OH | H | H | 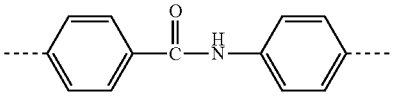 |

TABLE 2-continued
| Compound No. | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $R^{211}$ |
|---|---|---|---|---|---|---|---|---|---|---|---|
| E136 | O | O | H | H | H | C=O | H | OH | H | H | 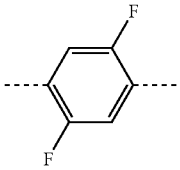 |
| E137 | O | O | H | H | H | C=O | H | OH | H | H | 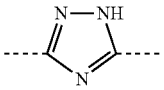 |
| E138 | O | O | H | H | H | C=O | H | OH | H | H | 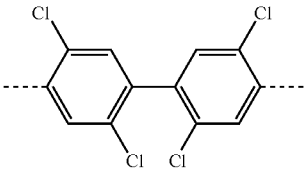 |
| E139 | O | O | H | H | H | C=O | H | OH | H | H | 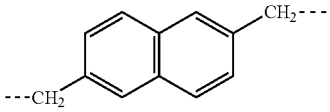 |
| E140 | O | O | H | H | H | C=O | H | OH | H | H | 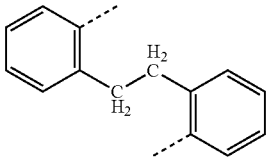 |
| E141 | O | O | H | H | H | C=O | H | OH | H | H | 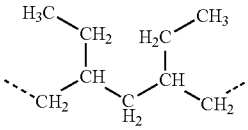 |
TABLE 3
| Compound No. | $R^{101}$ | $R^{102}$ | $R^{103}$ | $R^{104}$ | $R^{105}$ | $R^{106}$ | $R^{107}$ |
|---|---|---|---|---|---|---|---|
| E201 | 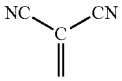 | 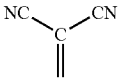 | H | H | NH | OH | H |
| E202 | 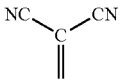 | 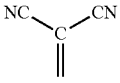 | H | H | NH | H | OH |
| E203 | 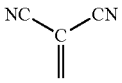 | 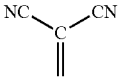 | H | H | NH | H | COOH |
| E204 | 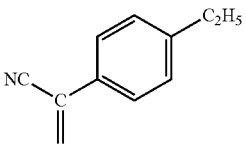 | 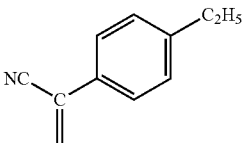 | H | H | $CH_2$ | H | OH |

TABLE 3-continued
| | | | | | | | |
|---|---|---|---|---|---|---|---|
| E205 | 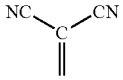 | 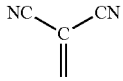 | H | H | NH | H | H |
| E206 | 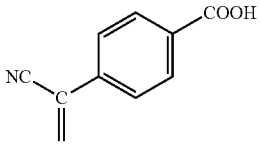 | 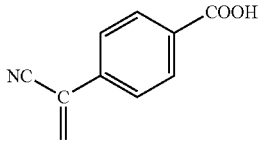 | H | H | NH | H | H |
| E207 | 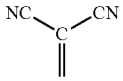 | 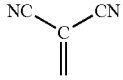 | H | H | O | H | H |
| E208 | 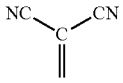 | 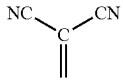 | H | H | C=O | H | H |
| E209 | 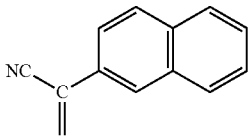 | 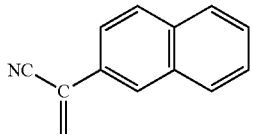 | H | H | C=O | H | H |
| E210 | 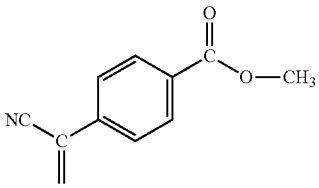 | 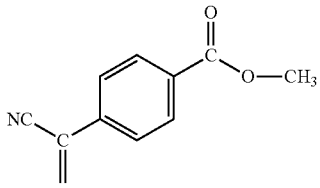 | H | H | O | H | H |
| E211 | 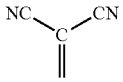 | 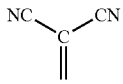 | H | H | NH | H | H |
| E212 | 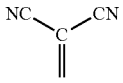 | 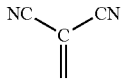 | H | H | NH | H | H |
| E213 | 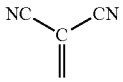 | 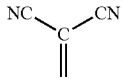 | H | H | C=O | H | H |
| E214 | 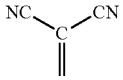 | 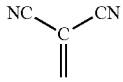 | H | H | O | H | H |
| E215 | 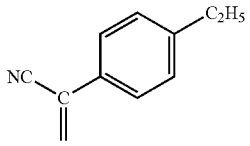 | 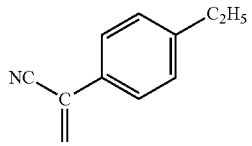 | H | H | $CH_2$ | H | H |
| E216 | 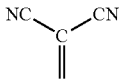 | 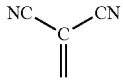 | H | H | NH | H | H |
| E217 | 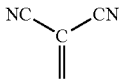 | 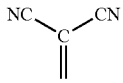 | H | H | C=O | H | Cl |
| E218 | 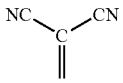 | 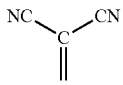 | H | H | NH | H | H |

TABLE 3-continued
| Compound No. | $R^{108}$ | $R^{109}$ | $R^{110}$ | $R^{111}$ |
|---|---|---|---|---|
| E201 | OH | H | H | 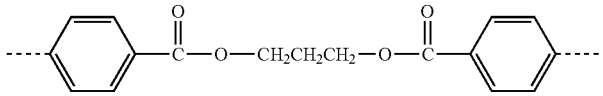 |
| E202 | H | H | H | 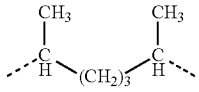 |
| E203 | H | H | H |  |
| E204 | $CH_2OH$ | H | H | 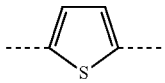 |
| E205 | OH | H | H | 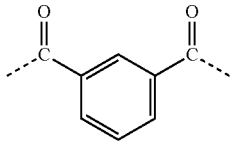 |
| E206 | OH | H | H | 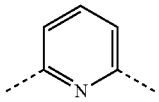 |
| E207 | OH | H | H | 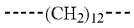 |
| E208 | OH | H | H | 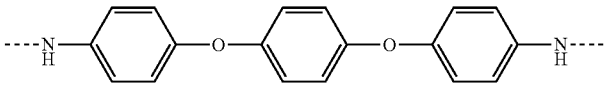 |
| E209 | OH | H | H | 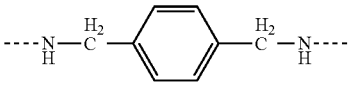 |
| E210 | OH | H | H | 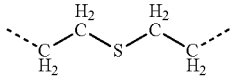 |
| E211 | H | H | H | 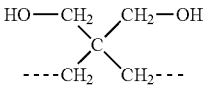 |
| E212 | H | H | H | 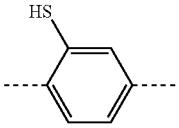 |
| E213 | H | H | H | 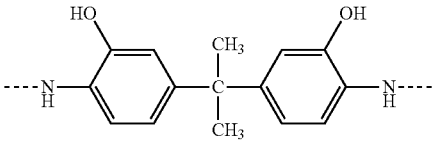 |
| E214 | H | H | H | 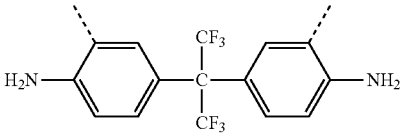 |

TABLE 3-continued
| | | | | |
|---|---|---|---|---|
| E215 | CN | CN | H | 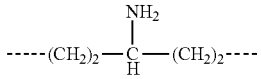 |
| E216 | H | H | Cl | 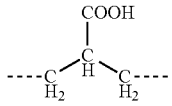 |
| E217 | H | H | Cl | 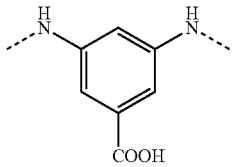 |
| E218 | H | H | H | 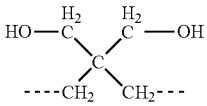 |
TABLE 4
| Compound No. | $R^{201}$ | $R^{202}$ | $R^{203}$ | $R^{204}$ | $R^{205}$ | $R^{206}$ | $R^{207}$ |
|---|---|---|---|---|---|---|---|
| E219 | 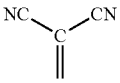 | 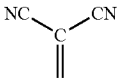 | H | H | H | C=O | H |
| E220 | 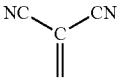 | 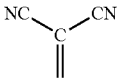 | H | H | H | NH | H |
| E221 | 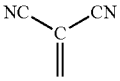 | 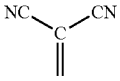 | H | H | H | NH | OH |
| E222 | 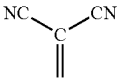 | 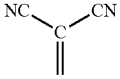 | H | H | H | NH | OH |
| E223 | 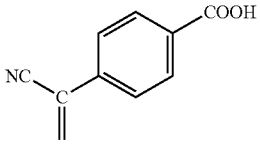 | 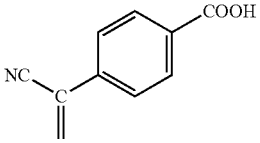 | H | H | H | $CH_2$ | COOH |
| E224 | 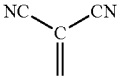 | 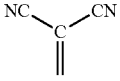 | H | H | H | C=O | COOH |
| E225 | 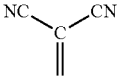 | 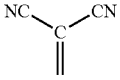 | H | H | H | C=O | H |
| Compound No. | $R^{208}$ | $R^{209}$ | $R^{210}$ | $R^{211}$ |
|---|---|---|---|---|
| E219 | H | H | Me | 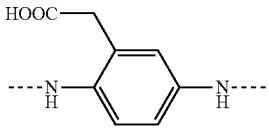 |

TABLE 4-continued
| | | | | |
|---|---|---|---|---|
| E220 | H | H | $NO_2$ | 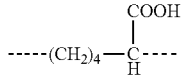 |
| E221 | $CH_2OH$ | H | H | 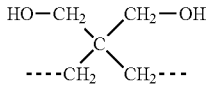 |
| E222 | $CH_2OH$ | H | H | 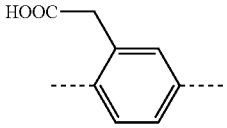 |
| E223 | H | H | H | 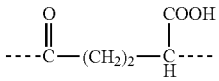 |
| E224 | H | H | H | 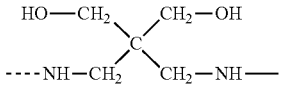 |
| E225 | OH | H | H | 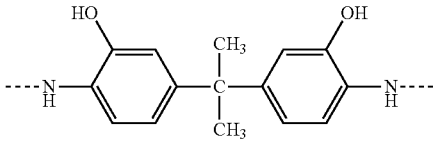 |
TABLE 5
| Compound No. | $R^{101}$ | $R^{102}$ | $R^{103}$ | $R^{104}$ | $R^{105}$ | $R^{106}$ | $R^{107}$ | $R^{108}$ |
|---|---|---|---|---|---|---|---|---|
| E301 | 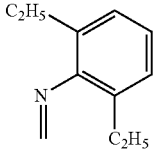 | 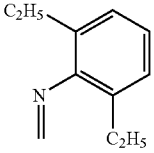 | H | H | NH | OH | H | OH |
| E302 | 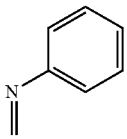 | 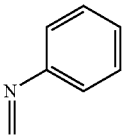 | H | H | NH | H | OH | H |
| E303 | 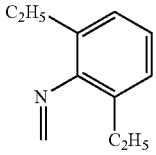 | 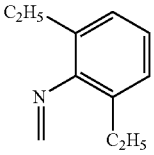 | H | H | NH | H | COOH | H |
| E304 | 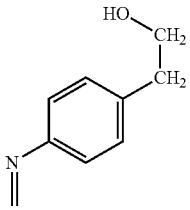 | 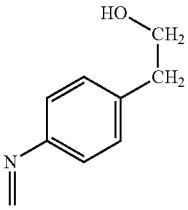 | H | H | $CH_2$ | H | OH | $CH_2OH$ |

TABLE 5-continued
| | | | | | | | | |
|---|---|---|---|---|---|---|---|---|
| E305 | 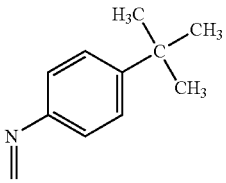 | 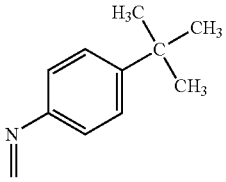 | H | H | NH | H | H | OH |
| E306 | 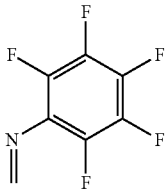 | 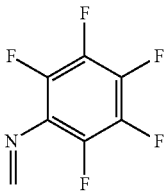 | H | H | NH | H | H | OH |
| E307 | 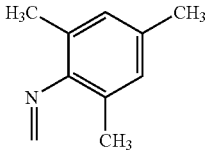 | 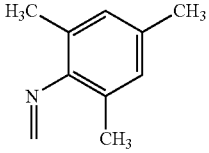 | H | H | O | H | H | OH |
| E308 | 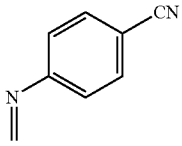 | 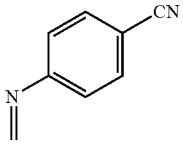 | H | H | C=O | H | H | OH |
| E309 | 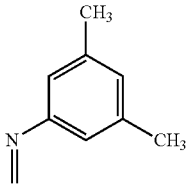 | 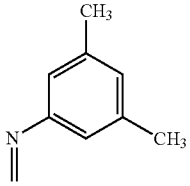 | H | H | C=O | H | H | OH |
| E310 | 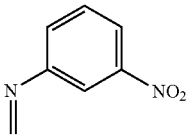 | 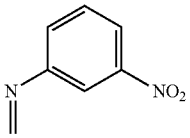 | H | H | O | H | H | OH |
| E311 | 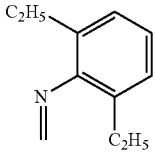 | 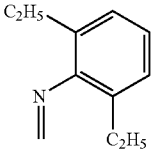 | H | H | NH | H | H | H |
| E312 | 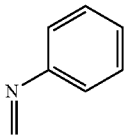 | 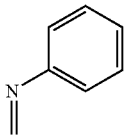 | H | H | NH | H | H | H |
| E313 | 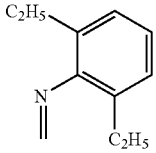 | 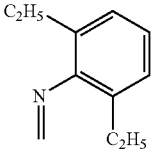 | H | H | C=O | H | H | H |

TABLE 5-continued
| | | | | | | | | |
|---|---|---|---|---|---|---|---|---|
| E314 | 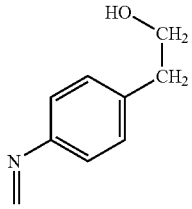 | 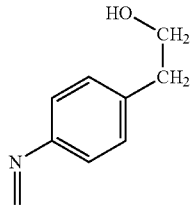 | H | H | O | H | H | H |
| E315 | 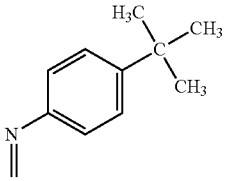 | 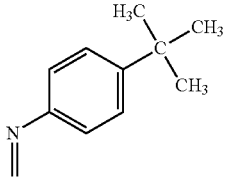 | H | H | $CH_2$ | H | H | CN |
| E316 | 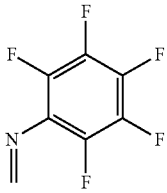 | 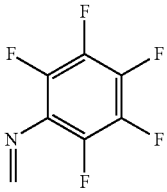 | H | H | NH | H | H | H |
| Compound No. | $R^{109}$ | $R^{110}$ | $R^{111}$ |
|---|---|---|---|
| E301 | H | H | 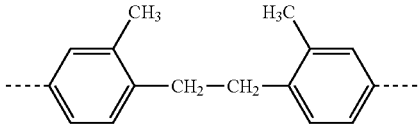 |
| E302 | H | H | 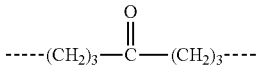 |
| E303 | H | H | 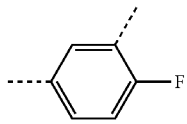 |
| E304 | H | H | 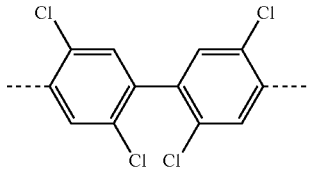 |
| E305 | H | H | 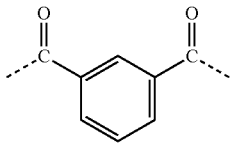 |
| E306 | H | H | 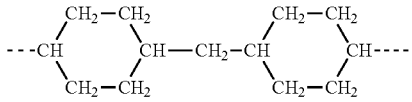 |
| E307 | H | H | 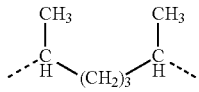 |

TABLE 5-continued
| | | | |
|---|---|---|---|
| E308 | H | H | 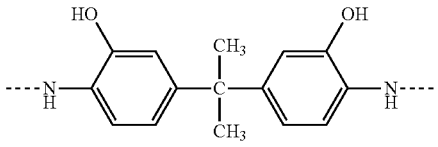 |
| E309 | H | H | 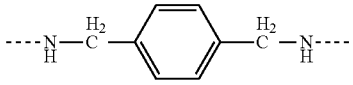 |
| E310 | H | H | 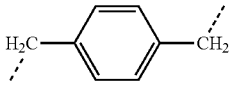 |
| E311 | H | H | 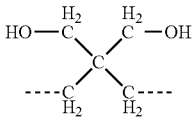 |
| E312 | H | H | 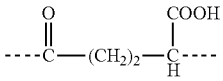 |
| E313 | H | H | 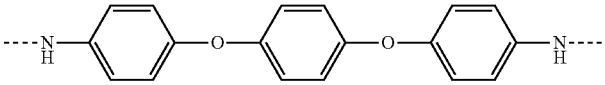 |
| E314 | H | H | 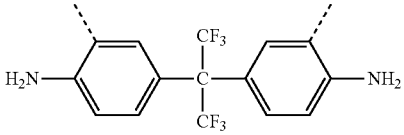 |
| E315 | CN | H | 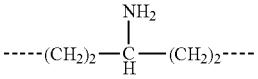 |
| E316 | H | Cl | 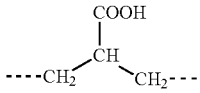 |
TABLE 6
| Compound No. | $R^{201}$ | $R^{202}$ | $R^{203}$ | $R^{204}$ | $R^{205}$ | $R^{206}$ | $R^{207}$ |
|---|---|---|---|---|---|---|---|
| E317 | 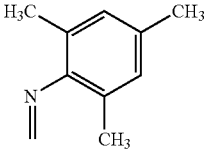 | 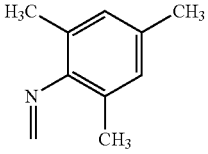 | H | H | H | C═O | Cl |
| E318 | 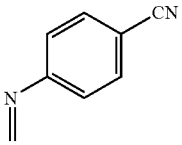 | 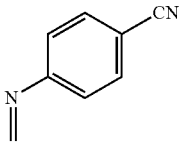 | H | H | H | NH | H |

TABLE 6-continued
| | | | | | | |
|---|---|---|---|---|---|---|
| E319 | 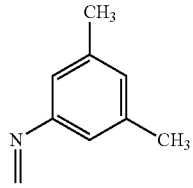 | 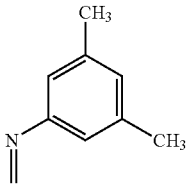 | H | H | H | C=O | H |
| E320 | 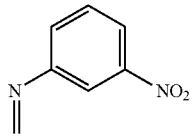 | 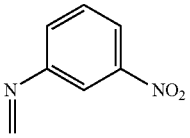 | H | H | H | NH | H |
| E321 | 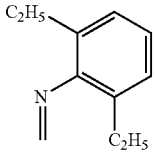 | 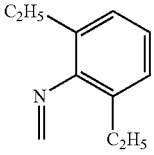 | H | H | H | NH | OH |
| E322 | 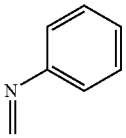 | 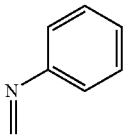 | H | H | H | NH | OH |
| E323 | 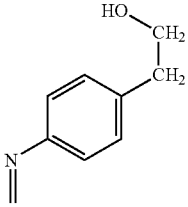 | 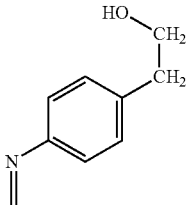 | H | H | H | $CH_2$ | COOH |
| E324 | 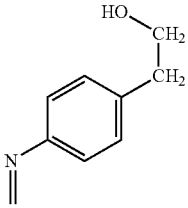 | 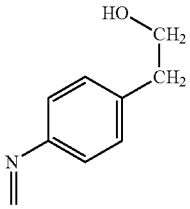 | H | H | H | C=O | COOH |
| E325 | 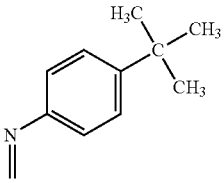 | 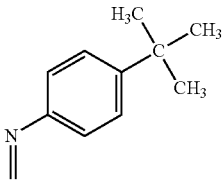 | H | H | H | C=O | H |
| Compound No. | $R^{208}$ | $R^{209}$ | $R^{210}$ | $R^{211}$ |
|---|---|---|---|---|
| E317 | H | H | Cl | 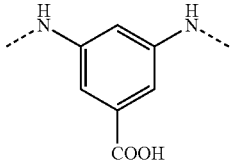 |
| E318 | H | H | Et | 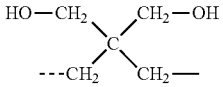 |

TABLE 6-continued

| | | | | |
|---|---|---|---|---|
| E319 | H | H | Me | 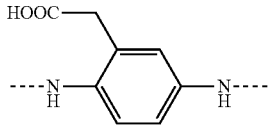 |
| E320 | H | H | $NO_2$ | 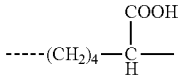 |
| E321 | $CH_2OH$ | H | H | 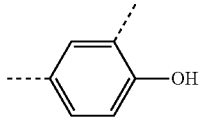 |
| E322 | $CH_2OH$ | H | H | 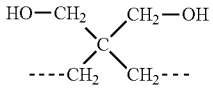 |
| E323 | H | H | H | 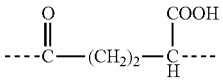 |
| E324 | H | H | H | 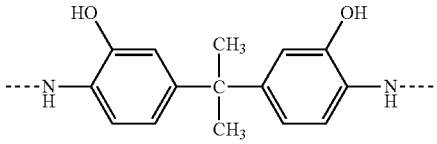 |
| E325 | OH | H | H | 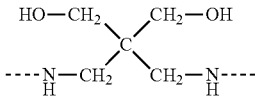 |

Methods of Obtaining Compound Represented by Formula (1) and Compound Represented by Formula (2)

The compound represented by the formula (1) or the compound represented by the formula (2) can be obtained by, for example, dimerizing a monomer having an anthraquinone structure.

The monomer having an anthraquinone structure can be synthesized by using, for example, a known synthesis method described in Bulletin of Tokai Women's Junior College 7, 1-11, (1980). In addition, the monomer can be purchased from, for example, Tokyo Chemical Industry Co., Ltd., Sigma-Aldrich Japan, or Johnson Matthey Japan G.K. (previous corporate name: Johnson Matthey Japan Incorporated).

A cyanated methylene structure or an imine structure may be introduced by causing a cyanated methylene derivative or an aniline derivative to act on the monomer having an anthraquinone structure.

Then, the monomers are linked to each other. Thus, the target dimer can be obtained.

A known method, e.g., the following method can be used for linking the monomers to each other: the monomer having introduced therein a functional group serving as a raw material and a compound having a plurality of functional groups capable of bonding to the functional group are caused to react with each other. The target dimer can be synthesized by using, for example, a known synthesis method described in Archives of Pharmacal Research, Vol 36, 5, 573-578 (2013), and any other known method can also be used.

Specifically, linking groups can be introduced by, for example, the following reaction.

There is given a method involving introducing an arylene group as a linking group into a halide of the monomer serving as a raw material through the use of a cross coupling reaction involving using a palladium catalyst and a base. There is also given a method involving introducing an alkylene group as a linking group through the use of a cross coupling reaction involving using an $FeCl_3$ catalyst and a base. There is also given a method involving causing the monomer having introduced therein a carboxyl group serving as a raw material and a diol compound or a diamino compound to react with each other to introduce a linking group through an ester bond or an amide bond. There is also given a method involving causing the monomer having introduced therein a hydroxy group serving as a raw material and a dicarboxyl compound or a diisocyanate compound to react with each other to introduce a linking group through an ester bond or a urethane bond. There is also given a method involving causing the monomer having introduced therein an amino group serving as a raw material and a dicarboxyl compound or a diisocyanate compound to react with each other to introduce a linking group through an amide bond or a urea bond.

A compound to be used in any such reaction can be purchased from, for example, Tokyo Chemical Industry Co., Ltd., Sigma-Aldrich Japan, or Johnson Matthey Japan G.K. (previous corporate name: Johnson Matthey Japan Incorporated).

In addition, two methods are each used for introducing a polymerizable functional group (a hydroxy group, a thiol group, an amino group, or a carboxyl group). The first method is a method involving directly introducing a structure having any such polymerizable functional group or a functional group that can be a precursor of the polymerizable functional group into a derivative of the compound represented by the formula (1) or of the compound represented by the formula (2).

For example, there is given a method involving introducing a polymerizable functional group-containing aryl group into a halide of the compound represented by the formula (1) or of the compound represented by the formula (2) serving as a raw material through the use of a cross coupling reaction involving using a palladium catalyst and a base. There is also given a method involving introducing a polymerizable functional group-containing alkyl group through the use of a cross coupling reaction involving using an $FeCl_3$ catalyst and a base instead of the cross coupling reaction involving using a palladium catalyst and a base. There is also given a method involving lithiating a halide of the compound represented by the formula (1) or of the compound represented by the formula (2) serving as a raw material, and then causing an epoxy compound or $CO_2$ to act on the lithiated product to introduce a hydroxyalkyl group or a carboxyl group.

The second method is a method involving using the monomer having an anthraquinone structure having the polymerizable functional group or the precursor thereof as a raw material, or using a compound having the polymerizable functional group or the precursor thereof as a linking group that links the monomers.

(Crosslinking Agent)

A compound that polymerizes (cures) or crosslinks with the compound represented by the formula (1) or the compound represented by the formula (2) to be incorporated into the composition can be used as the crosslinking agent. Specifically, for example, a compound disclosed in "Crosslinking Agent Handbook" edited by Shinzo Yamashita and Tosuke Kaneko, and published by TAISEISHA LTD. (1981) can be used.

Specific examples of the crosslinking agent include an isocyanate compound and an amine compound. Preferred examples of the isocyanate compound include the isocyanate compound having a plurality of isocyanate groups or blocked isocyanate groups. Examples of the isocyanate compound include triisocyanatobenzene, triisocyanatomethylbenzene, triphenylmethane triisocyanate, lysine triisocyanate, diisocyanates such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl 2,6-diisocyanatohexanoate, or norbornane diisocyanate, and an isocyanurate modified product, biuret modified product, allophanate modified product, and trimethylolpropane or pentaerythritol adduct modified product of the diisocyanates. Of those, an isocyanurate modified product and an adduct modified product are more preferred.

The blocked isocyanate group is a group having a structure represented by —$NHCOX^1$ (where $X^1$ represents a protective group). Although $X^1$ may represent any protective group as long as the protective group can be introduced into an isocyanate group.

As an isocyanate compound that may be commonly purchased, there may be given, for example, DURANATE MFK-60B or SBA-70B manufactured by Asahi Kasei Chemicals Corporation, and DESMODUR BL3175 or BL3475 manufactured by Sumika Bayer Urethane Co., Ltd. (new corporate name: Sumika Covestro Urethane Co., Ltd.).

The amine compound is preferably, for example, an amine compound having a plurality of N-methylol groups or alkyl-etherified N-methylol groups. Examples thereof include methylolated melamine, methylolated guanamine, a methylolated urea derivative, a methylolated ethylene urea derivative, methylolated glycoluril, and these compounds whose methylol sites are alkyl-etherified, and derivatives thereof.

As an amine compound that may be commonly purchased, there may be given, for example, U-VAN 20SE60 or 220 manufactured by Mitsui Chemicals, Inc., and SUPER BECKAMINE L-125-60 or G-821-60 manufactured by DIC Corporation.

In addition to the isocyanate compound and the amine compound, examples of the crosslinking agent also include various compounds, such as triglycidyl isocyanurate and 2,6-bis(hydroxymethyl)-p-cresol.

A mass ratio between the crosslinking agent and the anthraquinone derivative may be any ratio. Of those, the ratio (mass ratio) "crosslinking agent:anthraquinone derivative" preferably falls within a range of from 100:50 to 100:250.

When the mass ratio falls within the range, the agglomeration of the molecules of the crosslinking agent is suppressed. Probably as a result of the foregoing, the number of charge trap sites in the undercoat layer reduces and hence a ghost suppressing effect additionally improves.

(Macromonomer (Resin) Having Polymerizable Functional Group)

A macromonomer (resin) having a polymerizable functional group capable of polymerizing (curing) with any such crosslinking agent can be used as a resin to be incorporated into the composition. The macromonomer (resin) may be thermoplastic or thermosetting. Preferred examples of the polymerizable functional group include a hydroxy group, a thiol group, an amino group, a carboxyl group, and a methoxy group. The macromonomer having the polymerizable functional group preferably has a structural unit represented by the following formula (3).

(3)

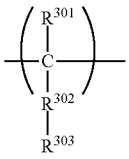

In the formula (3), $R^{301}$ represents a hydrogen atom or an alkyl group, $R^{302}$ represents a single bond, an alkylene group, or a phenylene group, and $R^{303}$ represents the polymerizable functional group and represents a hydroxy group, a thiol group, an amino group, a carboxyl group, or a methoxy group.

Examples of the macromonomer (resin) having the structural unit represented by the formula (3) include an acetal resin, a polyolefin resin, a polyester resin, a polyether resin, a polyamide resin, and a cellulose resin. That is, the macromonomer (resin) may further have any one of the following structural units (S-1) to (S-6) in addition to the structural unit represented by the formula (3). The formula (S-1) represents a structural unit of the acetal resin. The formula (S-2) represents a structural unit of the polyolefin resin. The formula (S-3) represents a structural unit of the polyester resin. The formula (S-4) represents a structural unit of the polyether resin. The formula (S-5) represents a structural unit of the polyamide resin. The formula (S-6) represents a structural unit of the cellulose resin.

(S-1)

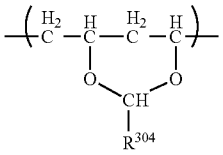

(S-2)

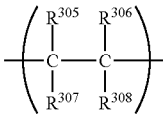

(S-3)

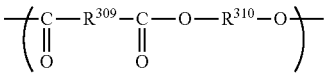

(S-4)

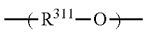

(S-5)

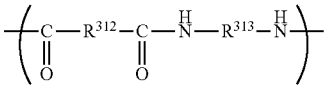

(S-6)

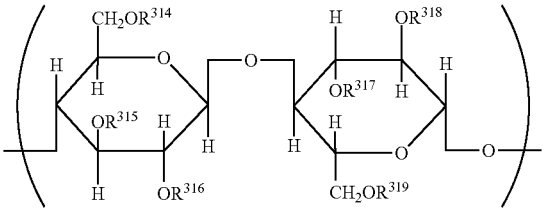

In the formulae, $R^{304}$ to $R^{308}$ each independently represent a substituted or unsubstituted alkyl group, a substituted or unsubstituted aryl group, or a hydrogen atom. When $R^{304}$ represents $C_3H_7$, the formula (S-1) represents butyral. $R^{309}$ to $R^{313}$ each represent a substituted or unsubstituted alkylene group, or a substituted or unsubstituted arylene group. $R^{314}$ to $R^{319}$ each represent an acetyl group, a hydroxyethyl group, a hydroxypropyl group, or a hydrogen atom.

The resin having the structural unit represented by the formula (3) is obtained by polymerizing a monomer having a polymerizable functional group that can be purchased from, for example, Sigma-Aldrich Japan or Tokyo Chemical Industry Co., Ltd.

In addition, the resin having the structural unit represented by the formula (3) can be generally purchased as a resin. Examples of the resin that can be purchased include: a polyether polyol-based resin such as AQD-457 or AQD-473 manufactured by Nippon Polyurethane Industry Co., Ltd., or SANNIX GP-400 or GP-700 manufactured by Sanyo Chemical Industries, Ltd.; a polyester polyol-based resin such as PHTHALKYD W2343 manufactured by Hitachi Chemical Co., Ltd., WATERSOL S-118 or CD-520 or BECKOLITE M-6402-50 or M-6201-40IM manufactured by DIC Corporation, HARIDIP WH-1188 manufactured by Harima Chemicals, Inc., or ES3604 or ES6538 manufactured by Japan U-Pica Company Ltd.; a polyacrylic polyol-based resin such as BURNOCK WE-300 or WE-304 manufactured by DIC Corporation; a polyvinyl alcohol-based resin such as KURARAY POVAL PVA-203 manufactured by KURARAY CO., LTD.; a polyvinyl acetal-based resin such as BX-1 or BM-1 manufactured by SEKISUI CHEMICAL CO., LTD.; a polyamide-based resin such as TORESIN FS-350 manufactured by Nagase ChemteX Corporation; a carboxyl group-containing resin such as AQUALIC manufactured by NIPPON SHOKUBAI CO., LTD. or FINELEX SG2000 manufactured by Namariichi Co., Ltd.; a polyamine resin such as LUCKAMIDE manufactured by DIC Corporation; and a polythiol resin such as QE-340M manufactured by Toray Fine Chemicals Co., Ltd. Of those, in particular, a polyvinyl acetal-based resin, a polyester polyol-based resin, or the like is preferred from the viewpoints of polymerizability and uniformity of an electron transporting layer.

The weight-average molecular weight (Mw) of the resin having the structural unit represented by the formula (3) more preferably falls within the range of from 600 to 400,000. In addition, in the present invention, the weight-average molecular weight of the resin is a weight-average molecular weight in terms of a polystyrene measured in accordance with an ordinary method, specifically by a method described in Japanese Patent Application Laid-Open No. 2007-79555.

Examples of a method of quantifying the polymerizable functional group in the resin having the structural unit represented by the formula (3) include the following methods: the titration of a carboxyl group with potassium hydroxide, the titration of an amino group with sodium nitrite, and the titration of a hydroxy group with acetic anhydride and potassium hydroxide. Further examples thereof include the titration of a thiol group with 5,5'-dithiobis(2-nitrobenzoic acid) and a calibration curve method involving obtaining the amount of the polymerizable functional group from the IR spectrum of a sample whose polymerizable functional group introduction ratio has been changed.

Specific examples (B1 to B23) of the resin having the structural unit represented by the formula (3) are shown in Table 7. In Table 7, the column "Structure" represents the kinds of the respective functional groups in the structural unit represented by the formula (3), and the column "Characteristic site" represents a structural unit which the resin has together with the structural unit represented by the formula (3), and represents a structural unit represented by any one of the formulae (S-1) to (S-6).

TABLE 7

| | Structure | | | Number of moles of polymerizable functional group | Characteristic | Weight-average molecular |
|---|---|---|---|---|---|---|
| | $R^{301}$ | $R^{302}$ | $R^{303}$ | per 1 g | site | weight |
| B1 | H | Single bond | OH | 3.3 mmol | Butyral | $1 \times 10^5$ |
| B2 | H | Single bond | OH | 3.3 mmol | Butyral | $4 \times 10^4$ |
| B3 | H | Single bond | OH | 3.3 mmol | Butyral | $2 \times 10^4$ |
| B4 | H | Single bond | OH | 1.0 mmol | Polyolefin | $1 \times 10^5$ |
| B5 | H | Single bond | OH | 3.0 mmol | Polyester | $8 \times 10^4$ |
| B6 | H | Single bond | OH | 2.5 mmol | Polyether | $5 \times 10^4$ |
| B7 | H | Single bond | OH | 2.8 mmol | Cellulose | $3 \times 10^4$ |
| B8 | H | Single bond | COOH | 3.5 mmol | Polyolefin | $6 \times 10^4$ |
| B9 | H | Single bond | $NH_2$ | 1.2 mmol | Polyamide | $2 \times 10^5$ |
| B10 | H | Single bond | SH | 1.3 mmol | Polyolefin | $8 \times 10^3$ |
| B11 | H | Phenylene | OH | 2.8 mmol | Polyolefin | $6 \times 10^4$ |
| B12 | H | Single bond | OH | 3.0 mmol | Butyral | $7 \times 10^4$ |
| B13 | H | Single bond | OH | 2.9 mmol | Polyester | $2 \times 10^4$ |

TABLE 7-continued

| | Structure | | | Number of moles of polymerizable functional group | Characteristic | Weight-average molecular |
|---|---|---|---|---|---|---|
| | $R^{301}$ | $R^{302}$ | $R^{303}$ | per 1 g | site | weight |
| B14 | H | Single bond | OH | 2.5 mmol | Polyester | $6 \times 10^3$ |
| B15 | H | Single bond | OH | 2.7 mmol | Polyester | $8 \times 10^4$ |
| B16 | H | Single bond | COOH | 1.4 mmol | Polyolefin | $2 \times 10^5$ |
| B17 | H | Single bond | COOH | 2.2 mmol | Polyester | $9 \times 10^3$ |
| B18 | H | Single bond | COOH | 2.8 mmol | Polyester | $8 \times 10^2$ |
| B19 | $CH_3$ | Single bond | OH | 2.0 mmol | Polyester | $5 \times 10^3$ |
| B20 | $C_2H_5$ | Single bond | OH | 1.2 mmol | Polyolefin | $6 \times 10^2$ |
| B21 | H | Single bond | OH | 3.3 mmol | Butyral | $2.7 \times 10^5$ |
| B22 | H | Single bond | OH | 3.3 mmol | Butyral | $4 \times 10^5$ |
| B23 | H | Single bond | OH | 2.5 mmol | Acetal | $4 \times 10^5$ |

The content of a structure derived from the macromonomer (resin) having the polymerizable functional group in the undercoat layer is preferably 60 mass % or less, more preferably 20 mass % or less, particularly preferably 10 mass % or less with respect to the total mass of the composition forming the undercoat layer. In addition, the content is preferably 3 mass % or more, more preferably 5 mass % or more.

(Other Material)

In addition to the polymerized product of the composition containing the compound represented by the formula (1) or the compound represented by the formula (2) and the crosslinking agent or the resin having a polymerizable functional group to be incorporated as required, the undercoat layer may contain any other substance for improving its film formability and electrical characteristics. The layer may contain, for example, a resin, an organic particle, an inorganic particle, or a leveling agent. However, the content of any such substance in the undercoat layer is preferably less than 50 mass %, more preferably less than 20 mass % with respect to the total mass of the undercoat layer. Of those substances, a metal oxide is incorporated at a content of 10 mass % or less, preferably less than 10 mass %, more preferably less than 5 mass % with respect to the total mass of the undercoat layer.

[Photosensitive Layer]

A photosensitive layer containing a charge generating substance and a hole transporting substance is arranged on the undercoat layer.

The photosensitive layer containing the charge generating substance and the hole transporting substance comes in the following types: a photosensitive layer obtained by laminating a charge generating layer containing the charge generating substance and a hole transporting layer containing the hole transporting substance in this order from a support side (hereinafter sometimes referred to as "laminated photosensitive layer"); and a photosensitive layer obtained by incorporating the charge generating substance and the hole transporting substance into the same layer (hereinafter sometimes referred to as "single-layer photosensitive layer"). The plurality of charge generating layers may be arranged, and the plurality of hole transporting layers may also be arranged.

Examples of the charge generating substance include an azo pigment, a perylene pigment, a quinone pigment, an indigoid pigment, a phthalocyanine pigment, and a perinone pigment. Of those, an azo pigment or a phthalocyanine pigment is preferred. Of the phthalocyanine pigment, oxytitanium phthalocyanine, chlorogallium phthalocyanine, or hydroxygallium phthalocyanine is preferred.

Examples of the binder resin to be used for the charge generating layer in the case where the photosensitive layer is the laminated photosensitive layer include: a polymer and copolymer of a vinyl compound, such as styrene, vinyl acetate, vinyl chloride, an acrylic acid ester, a methacrylic acid ester, vinylidene fluoride, or trifluoroethylene; polyvinyl alcohol; polyvinyl acetal; polycarbonate; polyester; polysulfone; polyphenylene oxide; polyurethane; a cellulose resin; a phenol resin; a melamine resin; a silicon resin; and an epoxy resin. Of those, polyester, polycarbonate, and polyvinyl acetal are preferred, and polyvinyl acetal is more preferred.

In the charge generating layer, the mass ratio (charge generating substance/binder resin) of the charge generating substance to the binder resin falls within the range of preferably from 10/1 to 1/10, more preferably from 5/1 to 1/5.

The thickness of the charge generating layer is preferably 0.05 μm or more and 5 μm or less.

Examples of the hole transporting substance include a polycyclic aromatic compound, a heterocyclic compound, a hydrazone compound, a styryl compound, a benzidine compound, a triarylamine compound, and triphenylamine. In addition, examples thereof also include a polymer having in its main chain or side chain a group resulting from any one of these compounds.

Examples of the binder resin to be used for the hole transporting layer in the case where the photosensitive layer is the laminated photosensitive layer include a polyester, a polycarbonate, a polymethacrylic acid ester, a polyarylate, a polysulfone, and a polystyrene. Of those, a polycarbonate and a polyarylate are preferred. In addition, it is preferred that the weight-average molecular weight (Mw) of any such binder resin fall within the range of from 10,000 to 300,000.

In the hole transporting layer, the ratio (hole transporting substance/binder resin) of the hole transporting substance to the binder resin is preferably from 10/5 to 5/10, more preferably from 10/8 to 6/10. The thickness of the hole transporting layer is preferably 5 μm or more and 40 μm or less.

It should be noted that another layer, such as an electroconductive layer obtained by dispersing electro-conductive particles made of a metal oxide, carbon black, or the like in a resin, or a second undercoat layer that does not contain the polymerized product of the composition containing an anthraquinone derivative to be used in the present invention, may be arranged between the support and the undercoat layer, or between the undercoat layer and the photosensitive layer.

In addition, a protective layer containing electro-conductive particles or the hole transporting substance and a binder resin may be arranged on the photosensitive layer (or in the case of the laminated photosensitive layer, the hole transporting layer). An additive, such as a lubricant, may be further incorporated into the protective layer. In addition, the resin (binder resin) itself of the protective layer may be provided with electro-conductivity or a hole transporting property, and in this case, the electro-conductive particles or the hole transporting substance except the resin may not be incorporated into the protective layer. In addition, the binder resin of the protective layer may be a thermoplastic resin, or may be a curable resin that can be cured with heat, light, a radiation (e.g., an electron beam), or the like.

A method of forming each layer constituting the electrophotographic photosensitive member, such as the undercoat layer or the photosensitive layer, is preferably a method involving: applying a coating liquid obtained by dissolving and/or dispersing a material constituting each layer in a solvent; and drying and/or curing the resultant coating film to form the layer. A method of applying the coating liquid is, for example, an immersion application method (immersion coating method), a spray coating method, a curtain coating method, or a spin coating method. Of those, the immersion application method is preferred from the viewpoints of efficiency and productivity.

[Process Cartridge and Electrophotographic Apparatus]

FIG. 1 is a view for illustrating the schematic construction of an electrophotographic apparatus including a process cartridge including an electrophotographic photosensitive member of the present invention.

In FIG. 1, a drum-shaped electrophotographic photosensitive member 1 of the present invention is rotationally driven about a rotation axis 2 in a direction indicated by the arrow at a predetermined peripheral speed. The surface (peripheral surface) of the electrophotographic photosensitive member 1 is charged to a predetermined positive or negative potential by a charging device 3 (e.g., a contact-type primary charger or a non-contact-type primary charger) in the course of its rotation. Next, the surface receives exposure light (image exposure light) 4 (e.g., laser light) from an exposing device (image exposing device) (not shown), such as slit exposure or laser beam scanning exposure. Thus, electrostatic latent images are sequentially formed on the surface of the electrophotographic photosensitive member 1.

Next, the formed electrostatic latent images are each developed with a toner of a developing device 5 (e.g., a contact-type developing device or a non-contact-type developing machine). The resultant toner images are sequentially transferred onto a transfer material 7 (e.g., paper) by a transferring device 6. The transfer material 7 is removed from a transfer material supplying portion (not shown) in synchronization with the rotation of the electrophotographic photosensitive member 1, and is fed to a gap between the electrophotographic photosensitive member 1 and the transferring device 6 (e.g., a transfer charger).

The transfer material 7 onto which the toner images have been transferred is separated from the surface of the electrophotographic photosensitive member 1, and is introduced into a fixing device 8 to undergo image fixation. Thus, the transfer material is printed out as a copied product (copy) to the outside of the electrophotographic apparatus.

The surface of the electrophotographic photosensitive member 1 after the transfer of the toner is subjected to the removal of a transfer residual toner by a cleaning device 9 to be cleaned, and is subjected to an antistatic treatment by pre-exposure light from a pre-exposing device (not shown). After that, the surface is repeatedly used in image formation.

A scorotron charger or a corotron charger utilizing corona discharge may be used as the charging device 3, or a contact-type charger including a charging member of, for example, a roller shape, a blade shape, or a brush shape may be used.

In the present invention, the electrophotographic photosensitive member 1 and at least one device selected from the group consisting of components such as the charging device 3, the developing device 5, the transferring device 6, and the cleaning device 9 may be integrally bonded to constitute a process cartridge. In addition, the process cartridge may be detachably mountable to the main body of an electrophotographic apparatus, such as a copying machine or a laser beam printer. For example, a cartridge is produced by integrally supporting at least one device selected from the group consisting of the charging device 3, the developing device 5, and the cleaning device 9 together with the electrophotographic photosensitive member 1. Then, the cartridge can be turned into a process cartridge 10 detachably mountable to the main body of the electrophotographic apparatus by using guiding devices, such as rails 11 and 12 of the main body of the electrophotographic apparatus.

Now, the present invention is described in more detail by way of Examples. Note that, the term "part(s)" in the examples refers to "part(s) by mass".

First, a synthesis example of the compound (anthraquinone derivative) represented by the formula (E111) is described.

Synthesis Example

Under room temperature and in a stream of nitrogen, 22 parts of 2-aminoanthraquinone, 13 parts of 2,2-bis(bromomethyl)-1,3-propanediol, 200 parts of dimethylacetamide, and 20 parts of triethylamine were loaded into a 300-milliliter three-necked flask, and were then heated to reflux for 24 hours.

After the completion of the reaction, the contents were emptied into ice water and extracted with ethyl acetate. After that, an organic layer was concentrated and then purified by silica gel column chromatography. The resultant solution was dried and hardened, and the hardened product was recrystallized with a mixture of ethyl acetate and hexane to provide 14 parts of the compound represented by the formula (E111) shown in Table 1.

It should be noted that the compound represented by the formula (1) except the compound represented by the formula (E111) or the compound represented by the formula (2) can also be obtained by the same method as the above-mentioned method or any other known synthesis method through the selection of a raw material corresponding to its structure, and compounds to be used in Examples below were synthesized by such methods.

Example 1

An aluminum cylinder (JIS-A3003, aluminum alloy) having a length of 260.5 mm and a diameter of 30 mm was subjected to liquid honing treatment under the following condition to obtain a support.

<Liquid Honing Condition>

Abrasive: abrasive grains=zirconia beads, grain size: 70 μm to 125 μm (trade name: Zirblast B120 manufactured by Material Science)

Suspension medium=water

Abrasive/suspension medium=1/9 (volume ratio)

The surface roughness of the cylinder after the honing was measured with a surface roughness meter SURFCORDER SE3500 manufactured by Kosaka Laboratory Ltd. in conformity with JIS B 0601 (1994). As a result, the cylinder was found to have a maximum height (RmaxD) of 2.01 μm, a ten-point average roughness (Rz) of 1.50 μm, and an arithmetic average roughness (Ra) of 0.21 μm.

Next, 4 parts of the compound (E218), 1 part of the resin represented by B1, and 0.002 part of dioctyltin laurylate were dissolved in a mixed solvent of 15 parts of methoxypropanol and 15 parts of tetrahydrofuran. An undercoat layer coating liquid was prepared by adding, to the solution, a crosslinking agent 1 (blocked isocyanate resin BL3575: manufactured by Sumika Bayer Co., Ltd.) corresponding to a solid content of 6 parts. $R^{304}$ of the formula (S-1) serving as the characteristic site of the resin B1 represents $C_3H_7$. The undercoat layer coating liquid was applied onto the support by immersion, and the resultant coating film was heated for 30 minutes at 170° C. to evaporate the solvent, and to polymerize and cure the compound represented by the formula (E218), the resin B1, and the crosslinking agent 1. Thus, an undercoat layer having a thickness of 0.75 μm was formed.

Next, a hydroxygallium phthalocyanine crystal (charge generating substance) of a crystal form having peaks at Bragg angles (2θ±0.2°) in CuKα characteristic X-ray diffraction of 7.5°, 9.9°, 12.5°, 16.3°, 18.6°, 25.1°, and 28.3° was prepared. 10 Parts of the hydroxygallium phthalocyanine crystal, 5 parts of polyvinyl butyral (trade name: S-LEC BX-1, manufactured by SEKISUI CHEMICAL CO., LTD.), and 250 parts of cyclohexanone were loaded into a sand mill using glass beads each having a diameter of 1 mm, and the mixture was subjected to dispersion treatment for 2 hours. Next, 250 parts of ethyl acetate were added to the resultant to prepare a charge generating layer coating liquid.

The charge generating layer coating liquid was applied onto the undercoat layer by immersion, and the resultant coating film was dried for 10 minutes at 95° C. to form a charge generating layer having a thickness of 0.18 μm.

Next, a hole transporting layer coating liquid was prepared by dissolving 6 parts of an amine compound (hole transporting substance) represented by the following formula (4), 2 parts of an amine compound (hole transporting substance) represented by the following formula (5), and 10 parts of a polycarbonate resin having a structural unit represented by the following formula (6) and having a weight-average molecular weight (Mw) of 80,000 in a mixed solvent of 40 parts of dimethoxymethane and 60 parts of orthoxylene.

(4)

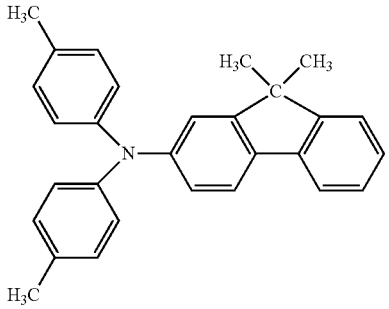

(5)

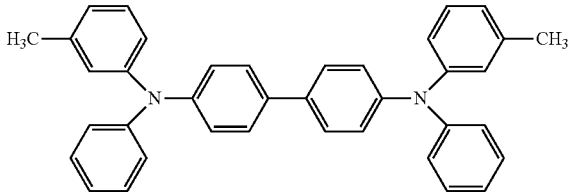

(6)

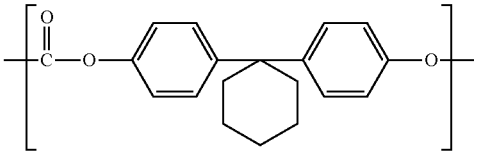

The hole transporting layer coating liquid was applied onto the charge generating layer by immersion, and the resultant coating film was dried for 40 minutes at 120° C. to form a hole transporting layer having a thickness of 15 μm.

Thus, an electrophotographic photosensitive member having, on the support, the undercoat layer, the charge generating layer, and the hole transporting layer was produced.

The produced electrophotographic photosensitive member was mounted to a reconstructed apparatus of a laser beam printer manufactured by Canon Inc. (trade name: LBP-2510) (primary charging: roller contact DC charging, process speed: 120 mm/sec, laser exposure) under an environment having a temperature of 23° C. and a humidity of 50% RH. Then, the evaluations of its surface potentials and the evaluations of output images at an initial stage and after image output on 15,000 sheets were performed. Details about the foregoing are as described below.

(Evaluation of Positive Ghost)

The process cartridge for a cyan color of the laser beam printer was reconstructed, and a potential probe (model 6000B-8: manufactured by Trek Japan) was mounted at its developing position. Next, the potential of the central portion of the electrophotographic photosensitive member was measured with a surface potentiometer (model 344: manufactured by Trek Japan). In addition, the light quantity of image exposure was set so that the dark potential (Vd) and light potential (Vl) became −600 V and −150 V, respectively.

Subsequently, the process cartridge for a cyan color of the laser beam printer was mounted with the produced electrophotographic photosensitive member, and the process cartridge was mounted to the station of the cyan process cartridge to output an image. First, a solid white image (1 sheet), an image for a ghost evaluation (5 sheets), a solid black image (1 sheet), and the image for a ghost evaluation (5 sheets) were continuously output in this order.

Figure 2:
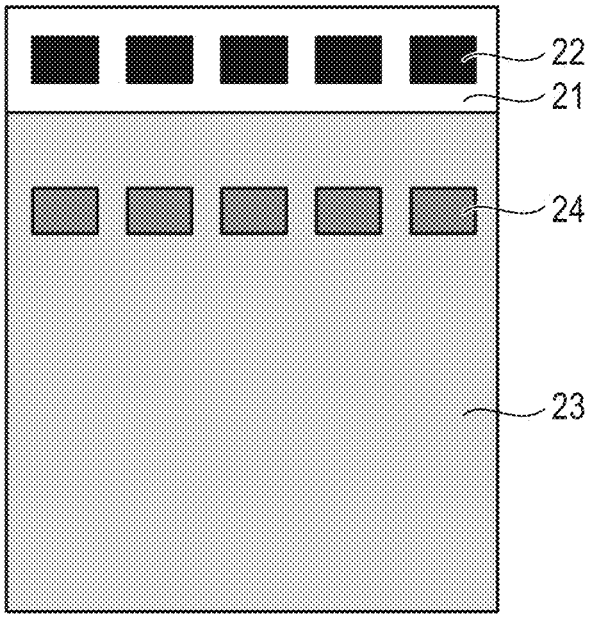
FIG. 2 is a diagram for illustrating an image for ghost evaluation (printing for ghost evaluation).
Figure 3:
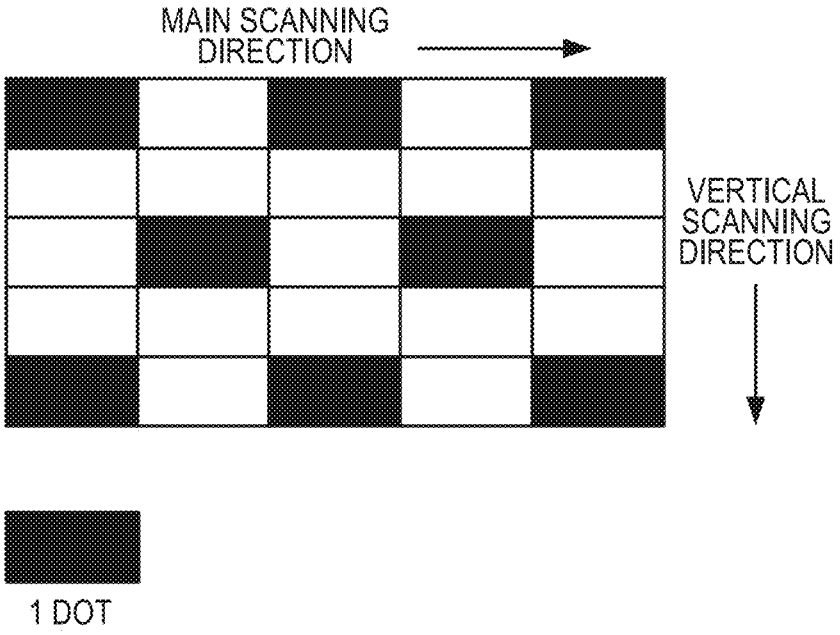
FIG. 3 is a diagram for illustrating a one-dot Keima pattern image.

As illustrated in FIG. 2, the image for a ghost evaluation is obtained by outputting a quadrangular solid image 22 in a white image 21 of the leading end portion of the image and then producing a halftone image 23 of a one-dot Keima pattern illustrated in FIG. 3.

The evaluation of a positive ghost was performed by measuring a density difference (Macbeth density difference) between the Macbeth density of the halftone image 23 of a one-dot Keima pattern and the Macbeth density of a ghost (portion where the positive ghost could occur). Macbeth density differences were measured at 10 points in 1 image for a ghost evaluation with a spectral densitometer (trade name: X-Rite 504/508, manufactured by X-Rite). The foregoing operation was performed on all the 10 images for a ghost evaluation, and the average of the measured values at a total of 100 points was calculated as a Macbeth density difference. An initial Macbeth density difference is shown in the column "Initial stage" of Table 8. Further, a difference between a Macbeth density difference after output on 15,000 sheets and the Macbeth density difference at the time of the initial image output is shown in the column "Before and after continuous image output (difference)" of Table 8, and a change ratio therebetween (the difference between the Macbeth density difference after the output on 15,000 sheets and the Macbeth density difference at the time of the initial image output/the Macbeth density difference at the time of the initial image output×100) is shown in the column "Before and after continuous image output (change ratio (%))" of Table 8. A smaller Macbeth density difference means that a positive ghost suppressing effect is larger. In addition, a smaller difference between the Macbeth density differences before and after the continuous image output, and a smaller change ratio therebetween mean that the positive ghost suppressing effects before and after the continuous image output are larger.

Examples 2 to 44

Electrophotographic photosensitive members were each produced in the same manner as in Example 1 except that the kinds and parts by mass of the compound, the crosslinking agent, and the resin were changed as shown in Table 8, and the members were each subjected to the evaluation of a ghost in the same manner as in Example 1. The results are shown in Table 8. $R^{305}$ to $R^{308}$ of the formula (S-2) serving as the characteristic site of the resin B11 each represent H. $R^{305}$ to $R^{308}$ of the formula (S-2) serving as the characteristic site of the resin B16 each represent H. $R^{304}$ of the formula (S-1) serving as the characteristic site of the resin B23 represents $C_3H_7$.

A crosslinking agent 2 is an isocyanate-based crosslinking agent (trade name: DESMODUR BL3175, manufactured by Sumika Bayer Co., Ltd. (solid content: 75%)). A crosslinking agent 3 is an isocyanate-based crosslinking agent (trade name: DESMODUR BL3475, manufactured by Sumika Bayer Co., Ltd. (solid content: 75%)). A crosslinking agent 4 is 1-methylbenzene-2,2,4,6-triyltriisocyanate (manufactured by Sigma-Aldrich). A crosslinking agent 5 is a butylated melamine-based crosslinking agent (trade name: SUPER BECKAMINE J821-60, manufactured by DIC Corporation (solid content: 60%)). A crosslinking agent 6 is a butylated urea-based crosslinking agent (trade name: BECKAMINE P138, manufactured by DIC Corporation (solid content: 60%)). A crosslinking agent 7 is 2,4,6-tris[bis(methoxymethyl)amino]-1,3,5-triazine (manufactured by Tokyo Chemical Industry Co., Ltd.).

Example 45

An electrophotographic photosensitive member was produced in the same manner as in Example 1 except that 0.4 part by mass of titanium oxide (trade name: TIPAQUE CR-EL, manufactured by Ishihara Sangyo Kaisha, Ltd.) was incorporated into the undercoat layer coating liquid, and the member was evaluated in the same manner as in Example 1. The results are shown in Table 8.

Example 46

An electrophotographic photosensitive member was produced in the same manner as in Example 28 except that 0.9 part by mass of titanium oxide (trade name: TIPAQUE CR-EL, manufactured by Ishihara Sangyo Kaisha, Ltd.) was incorporated into the undercoat layer coating liquid, and the member was evaluated in the same manner as in Example 28. The results are shown in Table 8.

Comparative Example 1

An electrophotographic photosensitive member was produced in the same manner as in Example 1 except that an anthraquinone derivative represented by the formula (7) was used instead of the compound (E218) of Example 1, and the member was evaluated in the same manner as in Example 1. The results are shown in Table 8.

(7)

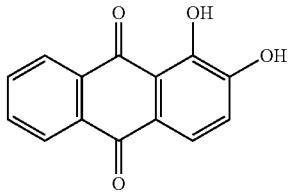

Comparative Example 2

An electrophotographic photosensitive member was produced in the same manner as in Example 1 except that an anthraquinone derivative represented by the formula (8) was used instead of the compound (E218) of Example 1, and the member was evaluated in the same manner as in Example 1. The results are shown in Table 8.

(8)

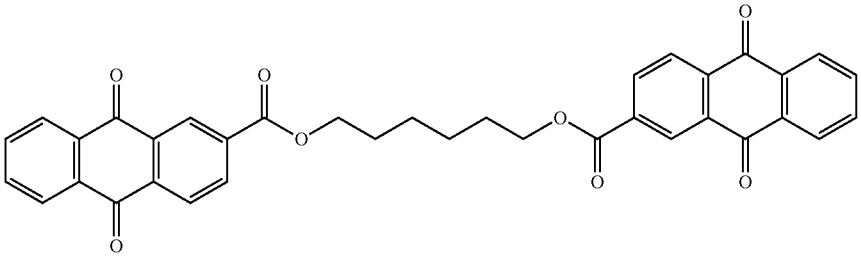

Examples 47 to 51

Electrophotographic photosensitive members were each produced in the same manner as in Example 1 except that the kinds and parts by mass of the compound, the crosslinking agent, and the resin were changed as shown in Table 8, and the members were each evaluated in the same manner as in Example 1 except that the evaluation was performed under a high-temperature and high-humidity environment (temperature: 32° C., relative humidity: 85%). The results are shown in Table 8.

Comparative Example 3

An electrophotographic photosensitive member was produced in the same manner as in Comparative Example 1, and the member was subjected to the evaluation of a ghost in the same manner as in Comparative Example 1 except that the evaluation was performed under a high-temperature and high-humidity environment (temperature: 32° C., relative humidity: 85%). The results are shown in Table 8.

TABLE 8

| | Compound | | Crosslinking agent | | Resin | | Evaluation of positive ghost | | |
|---|---|---|---|---|---|---|---|---|---|
| | | | | | | | | Before and after | Before and after |
| Example No. | Kind | Usage (part(s)) | Kind | Usage (part(s)) | Kind | Usage (part(s)) | Initial stage | continuous image output (difference) | continuous image output (change ratio (%)) |
| Example 1 | E218 | 4 | Crosslinking agent 1 | 6 | B1 | 1 | 0.030 | 0.012 | 40 |
| Example 2 | E201 | 4 | Crosslinking agent 1 | 6 | B1 | 1 | 0.031 | 0.015 | 48 |
| Example 3 | E203 | 4 | Crosslinking agent 1 | 6 | B1 | 1 | 0.033 | 0.012 | 36 |
| Example 4 | E221 | 4 | Crosslinking agent 1 | 6 | B1 | 1 | 0.034 | 0.013 | 38 |
| Example 5 | E222 | 4 | Crosslinking agent 1 | 6 | B1 | 1 | 0.030 | 0.013 | 43 |
| Example 6 | E218 | 4 | Crosslinking agent 2 | 6 | B1 | 1 | 0.034 | 0.011 | 32 |
| Example 7 | E218 | 4 | Crosslinking agent 3 | 6 | B1 | 1 | 0.030 | 0.012 | 40 |
| Example 8 | E218 | 4 | Crosslinking agent 4 | 6 | B1 | 1 | 0.033 | 0.012 | 36 |
| Example 9 | E218 | 4 | Crosslinking agent 5 | 6 | B1 | 1 | 0.030 | 0.012 | 40 |
| Example 10 | E218 | 4 | Crosslinking agent 5 | 6 | B1 | 1 | 0.031 | 0.011 | 35 |
| Example 11 | E218 | 4 | Crosslinking agent 6 | 6 | B1 | 1 | 0.032 | 0.011 | 34 |
| Example 12 | E218 | 4 | Crosslinking agent 7 | 6 | B1 | 1 | 0.031 | 0.013 | 42 |
| Example 13 | E204 | 4 | Crosslinking agent 1 | 6 | B1 | 1 | 0.030 | 0.012 | 40 |
| Example 14 | E206 | 4 | Crosslinking agent 1 | 6 | B1 | 1 | 0.031 | 0.012 | 39 |
| Example 15 | E210 | 4 | Crosslinking agent 1 | 6 | B1 | 1 | 0.031 | 0.015 | 48 |
| Example 16 | E215 | 4 | Crosslinking agent 1 | 6 | B1 | 1 | 0.030 | 0.016 | 53 |
| Example 17 | E223 | 4 | Crosslinking agent 1 | 6 | B1 | 1 | 0.033 | 0.015 | 45 |
| Example 18 | E101 | 4 | Crosslinking agent 1 | 6 | B1 | 1 | 0.035 | 0.013 | 37 |
| Example 19 | E102 | 4 | Crosslinking agent 1 | 6 | B1 | 1 | 0.036 | 0.012 | 33 |
| Example 20 | E105 | 4 | Crosslinking agent 1 | 6 | B1 | 1 | 0.035 | 0.016 | 46 |
| Example 21 | E111 | 4 | Crosslinking agent 1 | 6 | B1 | 1 | 0.035 | 0.012 | 34 |
| Example 22 | E118 | 4 | Crosslinking agent 1 | 6 | B1 | 1 | 0.037 | 0.012 | 32 |
| Example 23 | E121 | 4 | Crosslinking agent 1 | 6 | B1 | 1 | 0.038 | 0.015 | 39 |
| Example 24 | E123 | 4 | Crosslinking agent 1 | 6 | B1 | 1 | 0.035 | 0.013 | 37 |
| Example 25 | E101 | 4 | Crosslinking agent 1 | 7 | B1 | 1.5 | 0.038 | 0.013 | 34 |
| Example 26 | E101 | 5 | Crosslinking agent 1 | 1.5 | B1 | 0.5 | 0.035 | 0.013 | 37 |
| Example 27 | E301 | 4 | Crosslinking agent 1 | 6 | B1 | 1.5 | 0.040 | 0.012 | 30 |
| Example 28 | E304 | 4 | Crosslinking agent 1 | 6 | B1 | 1.5 | 0.042 | 0.013 | 31 |
| Example 29 | E305 | 4 | Crosslinking agent 1 | 4 | B1 | 1.5 | 0.042 | 0.011 | 26 |
| Example 30 | E313 | 4 | Crosslinking agent 1 | 7 | B1 | 1.5 | 0.040 | 0.011 | 28 |
| Example 31 | E314 | 4 | Crosslinking agent 1 | 6 | B1 | 1.5 | 0.043 | 0.014 | 33 |
| Example 32 | E318 | 4 | Crosslinking agent 1 | 6 | B1 | 1.5 | 0.040 | 0.014 | 35 |
| Example 33 | E320 | 4 | Crosslinking agent 1 | 6 | B1 | 1.5 | 0.041 | 0.013 | 32 |
| Example 34 | E324 | 4 | Crosslinking agent 1 | 6 | B1 | 1.5 | 0.042 | 0.015 | 36 |
| Example 35 | E208 | 4 | Crosslinking agent 1 | 6 | B23 | 1.5 | 0.032 | 0.022 | 69 |
| Example 36 | E213 | 4 | Crosslinking agent 1 | 6 | B1 | 1.5 | 0.030 | 0.023 | 77 |
| Example 37 | E217 | 4 | Crosslinking agent 1 | 6 | B1 | 1.5 | 0.033 | 0.024 | 73 |
| Example 38 | E209 | 4 | Crosslinking agent 1 | 6 | B1 | 1.5 | 0.031 | 0.021 | 68 |
| Example 39 | E108 | 4 | Crosslinking agent 1 | 6 | B1 | 1.5 | 0.035 | 0.026 | 74 |
| Example 40 | E113 | 4 | Crosslinking agent 1 | 6 | B1 | 1.5 | 0.036 | 0.022 | 61 |
| Example 41 | E125 | 4 | Crosslinking agent 1 | 6 | B11 | 1.5 | 0.037 | 0.022 | 59 |
| Example 42 | E313 | 4 | Crosslinking agent 1 | 6 | B1 | 1.5 | 0.040 | 0.021 | 53 |
| Example 43 | E317 | 4 | Crosslinking agent 1 | 6 | B16 | 1.5 | 0.043 | 0.024 | 56 |
| Example 44 | E313 | 4 | Crosslinking agent 1 | 6 | — | 0 | 0.045 | 0.022 | 49 |
| Example 45 | E218 | 4 | Crosslinking agent 1 | 6 | B1 | 1 | 0.037 | 0.017 | 46 |
| Example 46 | E304 | 4 | Crosslinking agent 1 | 6 | B1 | 1.5 | 0.048 | 0.018 | 38 |
| Comparative Example 1 | Compound (7) | 4 | Crosslinking agent 1 | 6 | B1 | 1 | 0.056 | 0.075 | 134 |
| Comparative Example 2 | Compound (8) | 4 | Crosslinking agent 1 | 6 | B1 | 1 | 0.068 | 0.123 | 181 |
| Example 47 | E107 | 4 | Crosslinking agent 1 | 6 | B1 | 1 | 0.043 | 0.037 | 86 |
| Example 48 | E110 | 4 | Crosslinking agent 1 | 6 | B1 | 1 | 0.043 | 0.036 | 84 |
| Example 49 | E101 | 4 | Crosslinking agent 1 | 6 | B1 | 1 | 0.041 | 0.016 | 39 |
| Example 50 | E123 | 4 | Crosslinking agent 1 | 6 | B1 | 1 | 0.040 | 0.017 | 43 |
| Example 51 | E141 | 4 | Crosslinking agent 1 | 6 | B1 | 1 | 0.044 | 0.028 | 64 |
| Comparative Example 3 | Compound (7) | 4 | Crosslinking agent 1 | 6 | B1 | 1 | 0.061 | 0.08 | 131 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-069746, filed Mar. 30, 2015, which is hereby incorporated by reference herein in its entirety.

What is claimed is:

1. An electrophotographic photosensitive member comprising, in this order:

a support;

an undercoat layer that contains at most 10 mass % metal oxide; and a photosensitive layer, wherein the undercoat layer contains a polymerized product of a composition containing at least one anthraquinone derivative selected from the group consisting of formula (1) and formula (2):

(1)

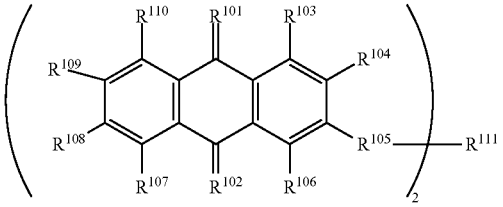

(2)

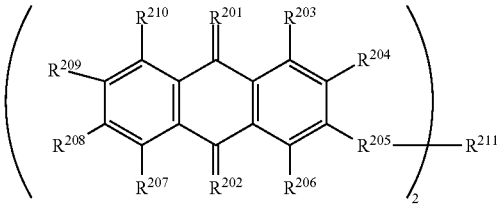

where $R^{101}$ and $R^{102}$ each independently represent an oxygen atom, $C(CN)_2$, $C(CN)R^{112}$ or $NR^{113}$, and $R^{112}$ and $R^{113}$ each represent a substituted or unsubstituted aryl group;

$R^{103}$, $R^{104}$ and $R^{106}$ to $R^{110}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{111}$ represents (i) a substituted or unsubstituted alkylene group, a substituted or unsubstituted cycloalkylene group, a substituted or unsubstituted arylene group, or a substituted or unsubstituted heterocyclic group, (ii) a group derived by substituting part of a methylene group in a main chain of the substituted or unsubstituted alkylene group with at least one kind selected from the group consisting of an oxygen atom, a sulfur atom, NH, $NR^{114}$, a carbonyl group, a sulfonyl group, a substituted or unsubstituted cycloalkylene group, and a substituted or unsubstituted arylene group, (iii) a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{114}$, a carbonyl group, and a sulfonyl group, or (iv) a group obtained by bonding, to the substituted or unsubstituted arylene group or the divalent group obtained by the bonding with the bonding group, at least one kind selected from the group consisting of an oxygen atom, a sulfur atom, NH, $NR^{115}$, a carbonyl group, and a sulfonyl group;

$R^{114}$ and $R^{115}$ each independently represent an alkyl group or an aryl group;

at least one of $R^{103}$, $R^{104}$ and $R^{106}$ to $R^{111}$ represents a group having any one of a hydroxy group, a thiol group, an amino group, and a carboxyl group;

$R^{105}$ represents a methylene group, a carbonyl group or NH;

$R^{201}$ and $R^{202}$ each independently represent an oxygen atom, $C(CN)_2$, $C(CN)R^{212}$ or $NR^{213}$, and $R^{212}$ and $R^{213}$ each represent a substituted or unsubstituted aryl group;

$R^{203}$ to $R^{205}$ and $R^{207}$ to $R^{210}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{211}$ represents (i) a substituted or unsubstituted alkylene group, a substituted or unsubstituted cycloalkylene group, a substituted or unsubstituted arylene group, or a substituted or unsubstituted heterocyclic group, (ii) a group derived by substituting part of a methylene group in a main chain of the substituted or unsubstituted alkylene group with at least one kind selected from the group consisting of an oxygen atom, a sulfur atom, NH, $NR^{214}$, a carbonyl group, a sulfonyl group, a substituted or unsubstituted cycloalkylene group, and a substituted or unsubstituted arylene group, (iii) a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{214}$, a carbonyl group, and a sulfonyl group, or (iv) a group obtained by bonding, to the substituted or unsubstituted arylene group or the divalent group obtained by the bonding with the bonding group, at least one kind selected from the group consisting of an oxygen atom, a sulfur atom, NH, $NR^{215}$, a carbonyl group, and a sulfonyl group;

$R^{214}$ and $R^{215}$ each independently represent an alkyl group or an aryl group;

at least one of $R^{203}$ to $R^{205}$ and $R^{207}$ to $R^{211}$ represents a group having any one of a hydroxy group, a thiol group, an amino group, and a carboxyl group; and $R^{206}$ represents a methylene group, a carbonyl group or NH.

2. An electrophotographic photosensitive member according to claim 1, wherein the composition further contains a crosslinking agent.

3. An electrophotographic photosensitive member according to claim 2, wherein the crosslinking agent comprises one of an isocyanate compound having one of an isocyanate group and a blocked isocyanate group, and an amine compound having one of an N-methylol group and an alkyletherified N-methylol group.

4. An electrophotographic photosensitive member according to claim 2, wherein the composition contains the crosslinking agent and a resin having a polymerizable functional group.

5. An electrophotographic photosensitive member according to claim 4, wherein the polymerizable functional group of the resin having the polymerizable functional group is any one of a hydroxy group, a thiol group, an amino group, a carboxyl group, and a methoxy group.

6. An electrophotographic photosensitive member according to claim 2, wherein a mass ratio between the crosslinking agent and the anthraquinone derivative is from 100:50 to 100:250.

7. A process cartridge, comprising:

an electrophotographic photosensitive member; and at least one device selected from the group consisting of a charging device, a developing device, a transferring device, and a cleaning device, the process cartridge integrally supporting the electrophotographic photosensitive member and the at least one device, and being detachably mountable to a main body of an electrophotographic apparatus, the electrophotographic photosensitive member comprising, in this order:

a support;

an undercoat layer that contains at most 10 mass % metal oxide; and a photosensitive layer, wherein the undercoat layer contains a polymerized product of a composition containing at least one kind of anthraquinone derivative selected from the group consisting of formula (1) and formula (2):

(1)

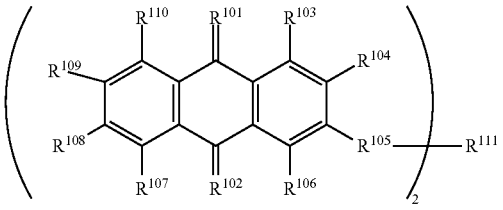

(2)

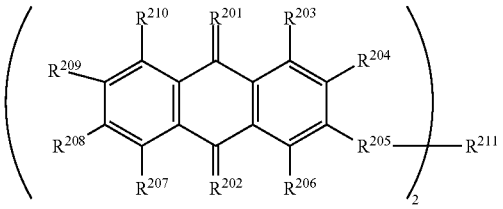

where $R^{101}$ and $R^{102}$ each independently represent an oxygen atom, $C(CN)_2$, $C(CN)R^{112}$ or $NR^{113}$, and $R^{112}$ and $R^{113}$ each represent a substituted or unsubstituted aryl group;

$R^{103}$, $R^{104}$ and $R^{106}$ to $R^{110}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{111}$ represents (i) a substituted or unsubstituted alkylene group, a substituted or unsubstituted cycloalkylene group, a substituted or unsubstituted arylene group, or a substituted or unsubstituted heterocyclic group, (ii) a group derived by substituting part of a methylene group in a main chain of the substituted or unsubstituted alkylene group with at least one kind selected from the group consisting of an oxygen atom, a sulfur atom, NH, $NR^{114}$, a carbonyl group, a sulfonyl group, a substituted or unsubstituted cycloalkylene group, and a substituted or unsubstituted arylene group, (ii) a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{114}$, a carbonyl group, and a sulfonyl group, or (iv) a group obtained by bonding, to the substituted or unsubstituted arylene group or the divalent group obtained by the bonding with the bonding group, at least one kind selected from the group consisting of an oxygen atom, a sulfur atom, NH, $NR^{115}$, a carbonyl group, and a sulfonyl group;

$R^{114}$ and $R^{115}$ each independently represent an alkyl group or an aryl group;

at least one of $R^{103}$, $R^{104}$ and $R^{106}$ to $R^{111}$ represents a group having any one of a hydroxy group, a thiol group, an amino group, and a carboxyl group;

$R^{105}$ represents a methylene group, a carbonyl group or NH;

$R^{201}$ and $R^{202}$ each independently represent an oxygen atom, $C(CN)_2$, $C(CN)R^{212}$ or $NR^{213}$, and $R^{212}$ and $R^{213}$ each represent a substituted or unsubstituted aryl group;

$R^{203}$ to $R^{205}$ and $R^{207}$ to $R^{210}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{211}$ represents (i) a substituted or unsubstituted alkylene group, a substituted or unsubstituted cycloalkylene group, a substituted or unsubstituted arylene group, or a substituted or unsubstituted heterocyclic group, (ii) a group derived by substituting part of a methylene group in a main chain of the substituted or unsubstituted alkylene group with at least one kind selected from the group consisting of an oxygen atom, a sulfur atom, NH, $NR^{214}$, a carbonyl group, a sulfonyl group, a substituted or unsubstituted cycloalkylene group, and a substituted or unsubstituted arylene group, (iii) a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{214}$, a carbonyl group, and a sulfonyl group, or (iv) a group obtained by bonding, to the substituted or unsubstituted arylene group or the divalent group obtained by the bonding with the bonding group, at least one kind selected from the group consisting of an oxygen atom, a sulfur atom, NH, $NR^{215}$, a carbonyl group, and a sulfonyl group;

$R^{214}$ and $R^{215}$ each independently represent an alkyl group or an aryl group;

at least one of $R^{203}$ to $R^{205}$ and $R^{207}$ to $R^{211}$ represents a group having any one of a hydroxy group, a thiol group, an amino group, and a carboxyl group; and $R^{206}$ represents a methylene group, a carbonyl group, or NH.

8. An electrophotographic apparatus, comprising:

an electrophotographic photosensitive member;

a charging device;

an exposing device;

a developing device; and a transferring device, the electrophotographic photosensitive member comprising, in this order:

a support;

an undercoat layer that contains at most 10 mass % metal oxide; and a photosensitive layer, wherein:

the undercoat layer contains a polymerized product of a composition containing at least one anthraquinone derivative selected from the group consisting of formula (1) and formula (2):

(1)

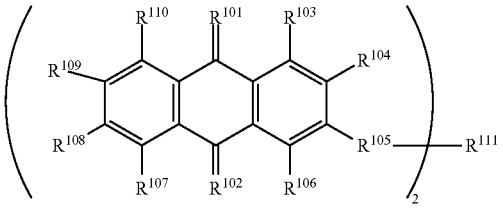

(2)

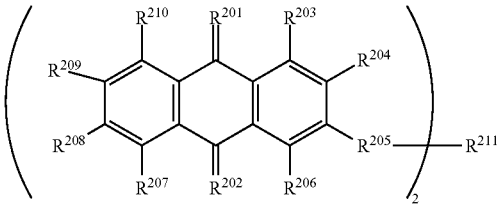

where $R^{101}$ and $R^{102}$ each independently represent an oxygen atom, $C(CN)_2$, $C(CN)R^{112}$ or $NR^{113}$, and $R^{112}$ and $R^{113}$ each represent a substituted or unsubstituted aryl group;

$R^{103}$, $R^{104}$ and $R^{106}$ to $R^{110}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{111}$ represents (i) a substituted or unsubstituted alkylene group, a substituted or unsubstituted cycloalkylene group, a substituted or unsubstituted arylene group, or a substituted or unsubstituted heterocyclic group, (ii) a group derived by substituting part of a methylene group in a main chain of the substituted or unsubstituted alkylene group with at least one kind selected from the group consisting of an oxygen atom, a sulfur atom, NH, $NR^{114}$, a carbonyl group, a sulfonyl group, a substituted or unsubstituted cycloalkylene group, and a substituted or unsubstituted arylene group, (iii) a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom NH, $NR^{114}$, a carbonyl group, and a sulfonyl group, or (iv) a group obtained by bonding, to the substituted or unsubstituted arylene group or the divalent group obtained by the bonding with the bonding group, at least one kind selected from the group consisting of an oxygen atom, a sulfur atom, NH, $NR^{115}$, a carbonyl group, and a sulfonyl group;

$R^{114}$ and $R^{115}$ each independently represent an alkyl group or an aryl group;

at least one of $R^{103}$, $R^{104}$ and $R^{106}$ to $R^{111}$ represents a group having any one of a hydroxy group, a thiol group, an amino group, and a carboxyl group;

$R^{105}$ represents a methylene group, a carbonyl group or NH;

$R^{201}$ and $R^{202}$ each independently represent an oxygen atom, $C(CN)_2$, $C(CN)R^{212}$ or $NR^{213}$, and $R^{212}$ and $R^{213}$ each represent a substituted or unsubstituted aryl group;

$R^{203}$ to $R^{205}$ and $R^{207}$ to $R^{210}$ each independently represent a group having any one of a hydroxy group, a thiol group, an amino group, and a carboxyl group, a hydrogen atom, a substituted or unsubstituted alkyl group, a substituted or unsubstituted aryl group, a halogen atom, a nitro group, a cyano group, an alkoxy group, or an alkoxycarbonyl group;

$R^{211}$ represents (i) a substituted or unsubstituted alkylene group, a substituted or unsubstituted cycloalkylene group, a substituted or unsubstituted arylene group, or a substituted or unsubstituted heterocyclic group, (ii) a group derived by substituting part of a methylene group in a main chain of the substituted or unsubstituted alkylene group with at least one kind selected from the group consisting of an oxygen atom, a sulfur atom, NH, $NR^{214}$, a carbonyl group, a sulfonyl group, a substituted or unsubstituted cycloalkylene group, and a substituted or unsubstituted arylene group, (iii) a divalent group obtained by bonding a plurality of groups selected from the group consisting of the substituted or unsubstituted cycloalkylene group, the substituted or unsubstituted arylene group, and the substituted or unsubstituted heterocyclic group with at least one kind of bonding group selected from the group consisting of a single bond, an oxygen atom, a sulfur atom, NH, $NR^{214}$, a carbonyl group, and a sulfonyl group, or (iv) a group obtained by bonding, to the substituted or unsubstituted arylene group or the divalent group obtained by the bonding with the bonding group, at least one kind selected from the group consisting of an oxygen atom, a sulfur atom, NH, $NR^{215}$, a carbonyl group, and a sulfonyl group;

$R^{214}$ and $R^{215}$ each independently represent an alkyl group or an aryl group;

at least one of $R^{203}$ to $R^{205}$ and $R^{207}$ to $R^{211}$ represents a group having any one of a hydroxy group, a thiol group, an amino group, and a carboxyl group; and $R^{206}$ represents a methylene group, a carbonyl group, or NH.

9. An electrophotographic photosensitive member according to claim 1, wherein the undercoat layer is free of a metal oxide.

* * * * *